US007067970B2

(12) United States Patent
Takeuchi et al.

(10) Patent No.: US 7,067,970 B2
(45) Date of Patent: Jun. 27, 2006

(54) LIGHT EMITTING DEVICE

(75) Inventors: Yukihisa Takeuchi, Nishikamo-gun (JP); Tsutomu Nanataki, Toyoake (JP); Iwao Ohwada, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 201 days.

(21) Appl. No.: 10/647,794

(22) Filed: Aug. 25, 2003

(65) Prior Publication Data

US 2005/0062390 A1 Mar. 24, 2005

(30) Foreign Application Priority Data

Sep. 30, 2002 (JP) ..... 2002-286207

(51) Int. Cl.
*H01J 1/62* (2006.01)
*H01J 63/04* (2006.01)
*H01J 63/05* (2006.01)

(52) U.S. Cl. ..... 313/495; 313/310; 315/169.2; 315/169.1

(58) Field of Classification Search ..... 313/310, 313/495, 496
See application file for complete search history.

(56) References Cited

U.S. PATENT DOCUMENTS 5,280,221 A * 1/1994 Okamoto et al. ..... 315/169.1
5,343,052 A * 8/1994 Oohata et al. ..... 257/141
5,453,661 A 9/1995 Auciello et al.
5,508,590 A 4/1996 Sampayan et al.
5,631,524 A * 5/1997 Matsuzaki et al. ..... 315/344
5,657,054 A * 8/1997 Files et al. ..... 345/177
5,666,019 A 9/1997 Potter
5,726,524 A 3/1998 Debe
5,729,094 A 3/1998 Geis et al.
5,747,926 A 5/1998 Nakamoto et al.
5,874,802 A 2/1999 Choi et al.
5,877,594 A 3/1999 Miyano et al.
5,990,605 A 11/1999 Yoshikawa et al.
6,040,973 A 3/2000 Okamoto et al.
6,153,978 A 11/2000 Okamoto
6,157,145 A 12/2000 Vollkommer et al.
6,184,612 B1 2/2001 Negishi et al.
6,198,225 B1 * 3/2001 Kano et al. ..... 315/169.3
6,274,881 B1 8/2001 Akiyama et al.
6,285,123 B1 9/2001 Yamada et al.
6,313,815 B1 11/2001 Takeda et al.

(Continued)

FOREIGN PATENT DOCUMENTS

DE 3833604 4/1990

(Continued)

OTHER PUBLICATIONS

Yasuoka, Ishii, "Pulsed Electron Source Using a Ferroelectric Cathode," Tokyo Institute of Technology, vol. 68, No. 5, Jan. 7, 1999, pp. 546-550.

(Continued)

*Primary Examiner*—Mariceli Santiago
*Assistant Examiner*—Elizabeth Rielley
(74) *Attorney, Agent, or Firm*—Burr & Brown

(57) ABSTRACT

A light emission device has an emitter made of a dielectric material, a cathode electrode disposed on a surface of the emitter, an anode electrode disposed on a reverse surface of the emitter, and a pulse generation source for applying a drive voltage between the cathode electrode and the anode electrode through a resistor. A fluorescent body is disposed on the surface of the emitter out of contact with the cathode, but as closely to the cathode electrode as possible.

27 Claims, 18 Drawing Sheets

U.S. PATENT DOCUMENTS

| | | | | |
|---|---|---|---|---|
| 6,359,383 | B1 | 3/2002 | Chuang et al. | |
| 6,452,328 | B1 | 9/2002 | Saito et al. | |
| 6,469,452 | B1 | 10/2002 | Seo et al. | |
| 6,479,924 | B1 | 11/2002 | Yoo | |
| 6,580,108 | B1 | 6/2003 | Utsumi et al. | |
| 2002/0060516 | A1 | 5/2002 | Kawate et al. | |
| 2002/0153827 | A1 | 10/2002 | Takeuchi et al. | |
| 2004/0046490 | A1* | 3/2004 | Doll | 313/485 |

FOREIGN PATENT DOCUMENTS

| | | | |
|---|---|---|---|
| DE | 10057072 | | 5/2001 |
| EP | 0 353 632 | | 2/1990 |
| EP | 428853 | | 5/1991 |
| EP | 0 953 958 | A2 | 11/1999 |
| FR | 2639151 | | 5/1990 |
| FR | 2675306 | | 10/1992 |
| FR | 2789221 | | 8/2000 |
| FR | 2789223 | | 8/2000 |
| JP | 44-26125 | | 11/1969 |
| JP | 46-20944 | | 6/1971 |
| JP | 59-208587 | | 11/1984 |
| JP | 63-150837 | A | 6/1988 |
| JP | 1-311533 | A | 12/1989 |
| JP | 05-325777 | | 12/1993 |
| JP | 7-147131 | A | 6/1995 |
| JP | 08-111166 | | 4/1996 |
| JP | 09-090882 | A | 4/1997 |
| JP | 10-27539 | A | 1/1998 |
| JP | 11-185600 | | 7/1999 |
| JP | 11-288249 | A | 10/1999 |
| JP | 2000-285801 | A | 10/2000 |
| JP | 2000-310970 | A | 11/2000 |
| JP | 3160213 | B2 | 2/2001 |
| JP | 3214256 | | 7/2001 |
| WO | 02/052600 | A1 | 7/2002 |

OTHER PUBLICATIONS

Puchkarev, Victor F. and Mesyats, Gennady A., "On the Mechanism of Emission from the Ferroelectric Ceramic Cathode," Journal of Applied Physics, vol. 78, No. 9, Nov. 1, 1995, pp. 5633-5637.

Riege, H., "Electron Emission from Ferroelectrics—a Review," Nucl. Instr. and Meth. A340, 1994, pp. 80-89.

Masatoshi Miyake et al., "*Electron Emission from Ferroelectric Cathodes Excited by Pulsed Voltage*," Tokyo Institute of Technology, vol. 119, No. 5, 1999 pp. 622-627.

G. Benedek et al., "Electron Emission From Ferroelectric/Antiferroelectric Cathodes Excited by Short High-Voltage Pulses", Journal Applied Physics, vol. 81, No. 3, Feb. 1, 1997, pp. 1396-1403.

Gundel, H. et al., "Low Pressure Hollow Cathode Switch Triggered by a Pulsed Electron Beam Emitted From Ferroelectrics", Applied Physics Letter, American Institute of Physics, New York, US vol. 54, No. 21, May 22, 1989, pp. 2071-2073.

Gundel, H. et al., "Time-Dependent Electron Emission From Ferroelectrics by External Pulsed Electric Fields", Journal of Applied Physics, American Institute of Physics, New York, US vol. 69, No. 2, Jan. 15, 1991, pp. 975-982.

U.S. Appl. No. 10/808,258, filed Mar. 24, 2004, Takeuchi et al.

U.S. Appl. No. 10/919,747, filed Aug. 17, 2001, Takeuchi et al.

U.S. Appl. No. 10/901,932, filed Jul. 29, 2004, Takeuchi et al.

U.S. Appl. No. 10/919,678, filed Aug. 17, 2004, Takeuchi et al.

Kanemaru, Seigou, "Featuring: All About Flat Displays 2000, Leading Technological Trend of FEDs," Electronic Engineering, Nikkan Kogyo Shimbun, Ltd., Jul. 2000, pp. 38-41 (with partial translation).

U.S. Appl. No. 10/951,509, filed Sep. 28, 2004, Takeuchi et al.

U.S. Appl. No. 10/950,976, filed Sep. 27, 2004, Takeuchi et al.

U.S. Appl. No. 10/952,524, filed Sep. 28, 2004, Takeuchi et al.

U.S. Appl. No. 10/951,832, filed Sep. 28, 2004, Takeuchi et al.

U.S. Appl. No. 10/791,521, filed Nov. 21, 2003, Takeuchi et al.

U.S. Appl. No. 10/719,596, filed Nov. 21, 2003, Takeuchi et al.

U.S. Appl. No. 10/730,754, filed Dec. 8, 2003, Takeuchi et al.

U.S. Appl. No. 10/731,901, filed Dec. 9, 2003, Takeuchi et al.

U.S. Appl. No. 10/374,955, filed Feb. 25, 2003, Takeuchi et al.

U.S. Appl. No. 10/459,415, filed Jun. 11, 2003, Takeuchi et al.

U.S. Appl. No. 10/459,110, filed Jun. 11, 2003, Takeuchi et al.

U.S. Appl. No. 10/459,416, filed Jun. 11, 2003, Takeuchi et al.

U.S. Appl. No. 10/459,386, filed Jun. 11, 2003, Takeuchi et al.

U.S. Appl. No. 10/673,384, filed Sep. 26, 2003, Takeuchi et al.

U.S. Appl. No. 10/671,763, filed Sep. 26, 2003, Takeuchi et al.

U.S. Appl. No. 10/678,958, filed Oct. 3, 2003, Takeuchi et al.

U.S. Appl. No. 10/699,186, filed Oct. 31, 2003, Takeuchi et al.

* cited by examiner

LIGHT EMITTING DEVICE

This application claims the benefit of Japanese Application 2002-286207, filed Sep. 30, 2002, the entirety of which is incorporated herein by reference.

BACKGROUND OF THE INVENTION

1. Field of the Invention

The present invention relates to a light emission device having a first electrode, a second electrode, and a fluorescent body which are disposed on a substance that serves as an emitter.

2. Description of the Related Art

In recent years, light emission devices employing electron emitters have been used in various applications such as field emission displays (FEDs) and backlight units. The electron emitter has an anode electrode and a cathode electrode as a basic element. In an FED, a plurality of electron emitters are arranged in a two-dimensional array, and a plurality of fluorescent bodies are positioned in association with the respective electron emitters with a predetermined gap left therebetween.

Conventional electron emitters are disclosed in, for example, Japanese laid-open patent publication No. 1-311533, Japanese laid-open patent publication No. 7-147131, Japanese laid-open patent publication No. 2000-285801, Japanese patent publication No. 46-20944, and Japanese patent publication No. 44-26125. All of these disclosed electron emitters are disadvantageous in that since no dielectric body is employed in the emitter, a forming process or a micromachining process is required between facing electrodes, a high voltage needs to be applied to emit electrons, and a panel fabrication process is complex and entails a high panel fabrication cost.

It has been considered to make an emitter of a dielectric material. The emission of electrons from a dielectric material has been discussed in Yasuoka, Ishii "Pulsed electron source using a ferroelectric cathode", J. Appl. Phys., Vol. 68, No. 5, p. 546–550 (1999), V. F. Puchkarev, G. A. Mesyats, "On the mechanism of emission from the ferroelectric ceramic cathode", J. Appl. Phys., Vol. 78. No. 9, November 1995, p. 5633–5637, and H. Riege, Electron emission from ferroelectrics—a review", Nucl. Instr. And Meth. A340, p. 80–89 (1994).

In the above light emission devices, electrons emitted from an electron emitter are accelerated by an electric field produced by a collector electrode, and applied through a vacuum atmosphere to a fluorescent body, which is excited to emit fluorescent light. Since the distance that the accelerated electrons travel (flying distance) is very large, the accelerated electrons tend to collide with gas molecules that are present in the vacuum atmosphere. Therefore, it is difficult to supply electrons stably from the electron emitter to the fluorescent body. As the flying distance of accelerated electrons is very large, the light emission device cannot be reduced in size.

A spacer is often provided between the electron emitter and the collector electrode for keeping the gap between the electron emitter and the collector electrode at a predetermined distance and also for achieving desired rigidity of the light emission device. However, some of the accelerated electrons are liable to hit the spacer, negatively charging the spacer. When the spacer is negatively charged, a field distribution between the electron emitter and the collector electrode, i.e., a field distribution for directing electrons emitted from the electron emitter toward the collector electrode, is changed, so that the fluorescent body will not be excited accurately by the electron beam, tending to cause image quality failures and crosstalk.

Another problem is that positive ions generated by a plasma in the vacuum atmosphere impinge upon the cathode electrode, damaging the cathode electrode in a so-called ion bombardment phenomenon.

In the conventional light emission device described above, electrons restrained by the surface of the dielectric material, the interface between the dielectric material and an upper electrode, and a defective level in the dielectric material are emitted by a reversal of the polarization of the dielectric material. Stated otherwise, if the polarization of the dielectric material is reversed, the number of emitted electrons becomes substantially constant independently of the voltage level of an applied voltage pulse.

However, the conventional light emission device is disadvantageous in that it is not practical as its electron emission is not stable and it can emit electrons as many times as several ten thousands at most.

SUMMARY OF THE INVENTION

It is therefore an object of the present invention to provide a light emission device which has an emitter made of a dielectric material, is capable of allowing electrons emitted from the emitter to impinge upon a fluorescent body without the need for a collector electrode thereby to excite the fluorescent body to emit fluorescent light therefrom, and is low in profile, lightweight, and low in cost.

A light emission device according to the present invention has a substance disposed in a vacuum atmosphere and serving as an emitter made of a dielectric material, and a first electrode, a second electrode, and a fluorescent body which are disposed in contact with the substance serving as the emitter. When a drive voltage is applied between the first electrode and the second electrode, the polarization of at least a portion of the substance serving as the emitter is reversed or changed to emit electrons from at least a portion of the first electrode. The substance serving as the emitter may be made of a piezoelectric material, an anti-ferroelectric material, or an electrostrictive material.

According to the present invention, there are two representative arrangements available for specific structural details of the light emission device. According to the first arrangement, the first electrode and the fluorescent body are disposed on a first surface of the substance serving as the emitter, and the second electrode is disposed on a second surface of the substance serving as the emitter.

According to the second arrangement, the first electrode and the second electrode are disposed in contact with a principal surface (the first surface) of the substance serving as the emitter, with a slit defined between the first electrode and the second electrode, the fluorescent body being disposed in at least the slit. The substance serving as the emitter may have a portion exposed between the first electrode and the fluorescent body and/or between the second electrode and the fluorescent body.

In the first and second arrangements, a step may include a preparatory period in which a first voltage making the potential of the first electrode higher than the potential of the second electrode is applied between the first electrode and the second electrode to polarize the substance serving as the emitter, and an electron emission period in which a second voltage making the potential of the first electrode lower than the potential of the second electrode is applied between the first electrode and the second electrode to reverse or change the polarization of the substance serving as the emitter to emit electrons therefrom, and the step may be repeated.

Electrons are emitted from a portion of the first electrode in the vicinity of a triple point made up of the first electrode, the substance serving as the emitter, and a vacuum atmosphere during the electron emission period in the step, and the emitted electrons impinge upon the fluorescent body to emit light therefrom.

Alternatively, electrons are emitted from a portion of the first electrode in the vicinity of a triple point made up of the first electrode, the substance serving as the emitter, and a vacuum atmosphere during the electron emission period in the step, and the emitted electrons are reflected by a surface of the substance serving as the emitter and impinge upon the fluorescent body to emit light therefrom.

Further alternatively, electrons are emitted from a portion of the first electrode in the vicinity of a triple point made up of the first electrode, the substance serving as the emitter, and a vacuum atmosphere during the electron emission period in the step, the emitted electrons impinge upon the substance serving as the emitter to emit secondary electrons therefrom, and the secondary electrons impinge upon the fluorescent body to emit light therefrom.

According to the second arrangement, particularly, a step includes a preparatory period in which a first voltage making the potential of the first electrode higher than the potential of the second electrode is applied between the first electrode and the second electrode to polarize the substance serving as the emitter, and an electron emission period in which a second voltage making the potential of the first electrode lower than the potential of the second electrode is applied between the first electrode and the second electrode to reverse the polarization of the substance serving as the emitter to emit electrons from the first electrode, and a first cycle includes at least one the step, a step includes a preparatory period in which the second voltage is applied between the first electrode and the second electrode to polarize the substance serving as the emitter, and an electron emission period in which the first voltage applied between the first electrode and the second electrode to reverse the polarization of the substance serving as the emitter to emit electrons from the second electrode, and a second cycle includes at least one the step, and operation of the first cycle and operation of the second cycle are selectively performed.

Electrons are emitted from a portion of the first electrode in the vicinity of a triple point made up of the first electrode, the substance serving as the emitter, and a vacuum atmosphere during the electron emission period in the step of the first cycle, and the emitted electrons impinge upon the fluorescent body to emit light therefrom, and electrons are emitted from a portion of the second electrode in the vicinity of a triple point made up of the second electrode, the substance serving as the emitter, and a vacuum atmosphere during the electron emission period in the step of the second cycle, and the emitted electrons impinge upon the fluorescent body to emit light therefrom.

Alternatively, electrons are emitted from a portion of the first electrode in the vicinity of a triple point made up of the first electrode, the substance serving as the emitter, and a vacuum atmosphere during the electron emission period in the step of the first cycle, and the emitted electrons are reflected by a surface of the substance serving as the emitter and impinge upon the fluorescent body to emit light therefrom, and electrons are emitted from a portion of the second electrode in the vicinity of a triple point made up of the second electrode, the substance serving as the emitter, and a vacuum atmosphere during the electron emission period in the step of the second cycle, and the emitted electrons are reflected by a surface of the substance serving as the emitter and impinge upon the fluorescent body to emit light therefrom.

Further alternatively, electrons are emitted from a portion of the first electrode in the vicinity of a triple point made up of the first electrode, the substance serving as the emitter, and a vacuum atmosphere during the electron emission period in the step of the first cycle, the emitted electrons impinge upon a surface of the substance serving as the emitter to emit secondary electrons therefrom, and the secondary electrons impinge upon the fluorescent body to emit light therefrom, and electrons are emitted from a portion of the second electrode in the vicinity of a triple point made up of the second electrode, the substance serving as the emitter, and a vacuum atmosphere during the electron emission period in the step of the second cycle, the emitted electrons impinge upon the substance serving as the emitter to emit secondary electrons therefrom, and the secondary electrons impinge upon the fluorescent body to emit light therefrom.

With the light emission device according to the present invention, electrons emitted from the surface of the first electrode, the second electrode, or the substance serving as the emitter impinge upon the fluorescent body disposed in the vicinity of the first electrode, exciting the fluorescent body to emit light therefrom.

Therefore, the light emission device does not need to have a collector electrode. As a result, the light emission device may be low in profile, lightweight, and low in cost.

Inasmuch as the distance from the electron emission region of the first electrode or the second electrode to the fluorescent body is short, almost all of the discharged electrons can reach the fluorescent body without impinging upon gas molecules even when the vacuum atmosphere has a low vacuum level of 2000 Pa. Thus, a number of electrons that impinge upon the fluorescent body which are required to achieve a desired luminance level of light emission can be maintained. A higher vacuum level of $10^{-3}$ Pa or less is preferable for higher luminance.

In the first arrangement, atoms produced when a portion of the substance serving as the emitter is evaporated are floating in the vicinity of the emitter. In the second arrangement, atoms produced when a portion of the second electrode and the substance serving as the emitter is evaporated are floating in the vicinity of the electrode (e.g., the second electrode) to which a positive voltage is applied.

If a collector electrode were present, then when the discharged electrodes travel toward the collector electrode, the electrons would ionize the gas and the atoms into positive ions and electrons. Since the electrons thus generated by the ionization would further ionize the gas and the atoms, electrons are exponentially multiplied to generate a local plasma in which the electrons and the positive ions are neutrally present. The generated positive ions would impinge upon the substance serving as the emitter and the electrode (e.g., the first electrode) to which a negative voltage is applied, tending to damage the substance serving as the emitter and the first electrode (ion bombardment phenomenon).

According to the present invention, however, inasmuch as there is no collector electrode and the distance that the discharged electrons are accelerated and fly is small, the discharged electrons do not substantially ionize the gas present in the vicinity of the substance serving as the emitter or atoms of the second electrode into positive ions and electrons. As a result, the number of areas where positive ions are generated in the vacuum atmosphere is reduced, and the problem of damage caused to the substance serving as the emitter and the first electrode by the ion bombardment phenomenon is avoided.

If a plurality of light emission devices are arrayed into a single display, then since the distance from the electron emission region of the first electrode or the second electrode to the fluorescent body is short and the distance that the discharged electrons are accelerated and fly is small in each of the light emission devices, electrons emitted from each of the light emission devices do not impinge upon the fluorescent bodies of adjacent light emission devices, and hence there is no crosstalk between the light emission devices.

If a plurality of light emission devices are arrayed into a single display with a display panel, one or more spacers may be interposed between the light emission devices and the display panel in order to keep rigid the display including the display panel and to maintain the gap between the light emission devices and the display panel at a predetermined distance. The spacer or spacers are not charged because electrons emitted from the light emission devices do not fly to the spacer. Even if the spacer is charged for some reasons, producing an unwanted field distribution between the light emission devices and the spacer, the electrons are not affected by the unwanted field distribution because the distance that the discharged electrons are accelerated and fly is small.

With the light emission device in which the substance serving as the emitter made of the dielectric material according to the present invention, therefore, electrons discharged from the emitter are caused to impinge upon the fluorescent body without using a collector electrode, exciting the fluorescent body to emit light. The light emission device can effectively be rendered low in profile, lightweight, and low in cost.

In the first arrangement, the first electrode and the fluorescent body may have an outer peripheral edge and an inner peripheral edge, respectively, which face each other, i.e., the outer peripheral edge of the first electrode may be surrounded by the fluorescent body. The outer peripheral portion of the first electrode contributes to the emission of electrons, thus increasing the amount of emitted light. By appropriately selecting the area of the first electrode and the projected shape thereof as viewed in plan, the amount of emitted light and the electrostatic capacitance between the first electrode and the second electrode can be optimized for reducing the power consumption and increasing the amount of emitted light.

In the first arrangement, the fluorescent body and the first electrode may have an outer peripheral edge and an inner peripheral edge, respectively, which face each other. If this structure is combined with the above structure in which the outer peripheral edge of the first electrode and the inner peripheral edge of the fluorescent body face each other, then the light emission device can emit a maximum amount of light with a minimum level of power consumption.

In the first arrangement, the first electrode and the second electrode may have respective projected shapes as viewed in plan, and the projected shape of the second electrode may have a protruding portion which protrudes from a peripheral edge of the projected shape of the first electrode. The projected shape of the first electrode and the projected shape of the second electrode may be similar to each other.

With this structure, the portion of the substance serving as the emitter which corresponds to the protruding portion of the second electrode can have its polarization reversed or changed easily. Since the electric field is concentrated from the protruding portion toward the peripheral edge of the first electrode, electrons can easily be emitted from around the triple point.

As the protruding portion is larger, the concentration of the electric field on the triple point increases. Therefore, the protruding portion should preferably have a maximum length of at least 1 μm. Since the increase in the concentration of the electric field becomes saturated at a certain level, the maximum length of the protruding portion should preferably be of a value which does not adversely affect efforts to reduce the size of the light emission device, i.e., at most 500 μm.

In the second arrangement, the first electrode and the fluorescent body may have an outer peripheral edge and an inner peripheral edge, respectively, which face each other, i.e., the outer peripheral edge of the first electrode may be surrounded by the fluorescent body. Furthermore, the fluorescent body and the second electrode may have an outer peripheral edge and an inner peripheral edge, respectively, which face each other, i.e., the outer peripheral edge of the fluorescent body may be surrounded by the second electrode.

Alternatively, the second electrode and the fluorescent body may have an outer peripheral edge and an inner peripheral edge, respectively, which face each other, i.e., the outer peripheral edge of the second electrode may be surrounded by the fluorescent body. Furthermore, the fluorescent body and the first electrode may have an outer peripheral edge and an inner peripheral edge, respectively, which face each other, i.e., the outer peripheral edge of the fluorescent body may be surrounded by the first electrode.

In the first and second arrangements, the fluorescent body may be is disposed in covering relation to the second electrode. With this structure, the fluorescent body thus performs the function of a charged film. Specifically, when some of the discharged electrons are drawn to the second electrode, they negatively charge the surface of the fluorescent body. The positive polarity of the anode electrode is now weakened, reducing the intensity of the electric field between the first electrode and the second electrode, thereby instantaneously stopping the ionization. Thus, there is essentially no change in the voltage between the first electrode and the second electrode upon the emission of electrons. As a result, almost no positive ions are produced, thus preventing the first electrode from being damaged by positive ions. The light emission device can thus have an increased service life. The fluorescent body covering the second electrode also performs the function of a protective film.

With the light emission device in which the substance serving as the emitter made of the dielectric material according to the present invention, as described above, electrons discharged from the emitter are caused to impinge upon the fluorescent body without using a collector electrode, exciting the fluorescent body to emit light. The light emission device can effectively be rendered low in profile, lightweight, and low in cost.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Light emission devices according to preferred embodiments of the present invention will be described in detail below with reference to FIGS. 1 through 18.

Light emission devices according to the present invention can be used in displays, electron beam irradiation apparatus, light sources, LED alternatives, and electronic parts manufacturing apparatus.

An electron beam in an electron beam irradiation apparatus has a higher energy and a better absorption capability than ultraviolet rays in ultraviolet ray irradiation apparatus that are presently in widespread use. Light emission devices are used to solidify insulating films in superposing wafers for semiconductor devices, harden printing inks without irregularities for drying prints, and sterilize medical devices while being kept in packages.

Light emission devices are also used as high-luminance, high-efficiency light sources for use in projectors, for example, which employ an ultrahigh-pressure mercury lamp or the like. If an electron pulse emission device according to the present invention is applied to a light source, then it can be reduced in size, has a longer service life, can be turned on at a higher speed, and is capable of reducing environmental burdens because it is free of mercury.

Light emission devices are also used as LED alternatives in planar light source applications including indoor illumination devices, automobile lamps, and traffic signal devices, and also in chip light sources, traffic signal devices, and backlight units for small-size liquid-crystal display devices for cellular phones.

Light emission devices are also used in electronic parts manufacturing apparatus including electron beam sources for film growing apparatus such as electron beam evaporation apparatus, electron sources for generating a plasma (to activate a gas or the like) in plasma CVD apparatus, and electron sources for decomposing gases. Light emission devices are also used in vacuum micro devices including ultrahigh-speed devices operable in a tera-Hz range and large-current output devices. Light emission devices are also used in printer parts, i.e., light emission devices for exposing photosensitive drums to light, and electron sources for charging dielectric bodies.

Light emission devices are also used in electronic circuit parts including digital devices such as switches, relays, diodes, etc. and analog devices such as operational amplifiers, etc. as they can be designed for outputting large currents and high amplification factors.

Figure 1:
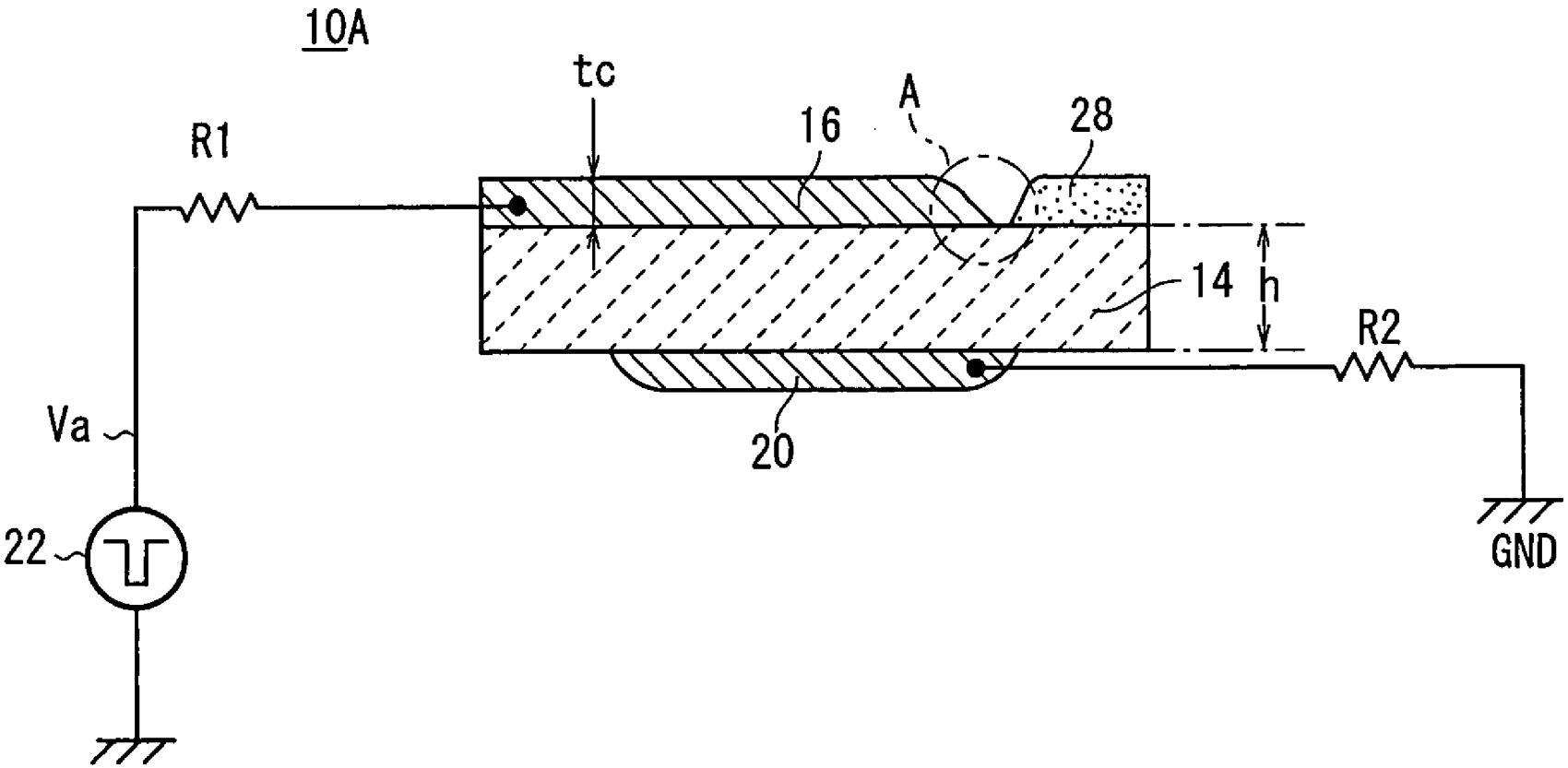
FIG. 1 is a view of a light emission device according to a first embodiment of the present invention.

As shown in FIG. 1, a light emission device 10A according to a first embodiment of the present invention has a plate-like emitter (a substance serving as an emitter) 14, a first electrode (cathode electrode) 16 formed on one surface of the emitter 14, a second electrode (anode electrode) 20 formed on the reverse surface of the emitter 14, and a pulse generation source 22 for applying a drive voltage Va between the cathode electrode 16 and the anode electrode 20 through a resistor R1.

Figure 2:
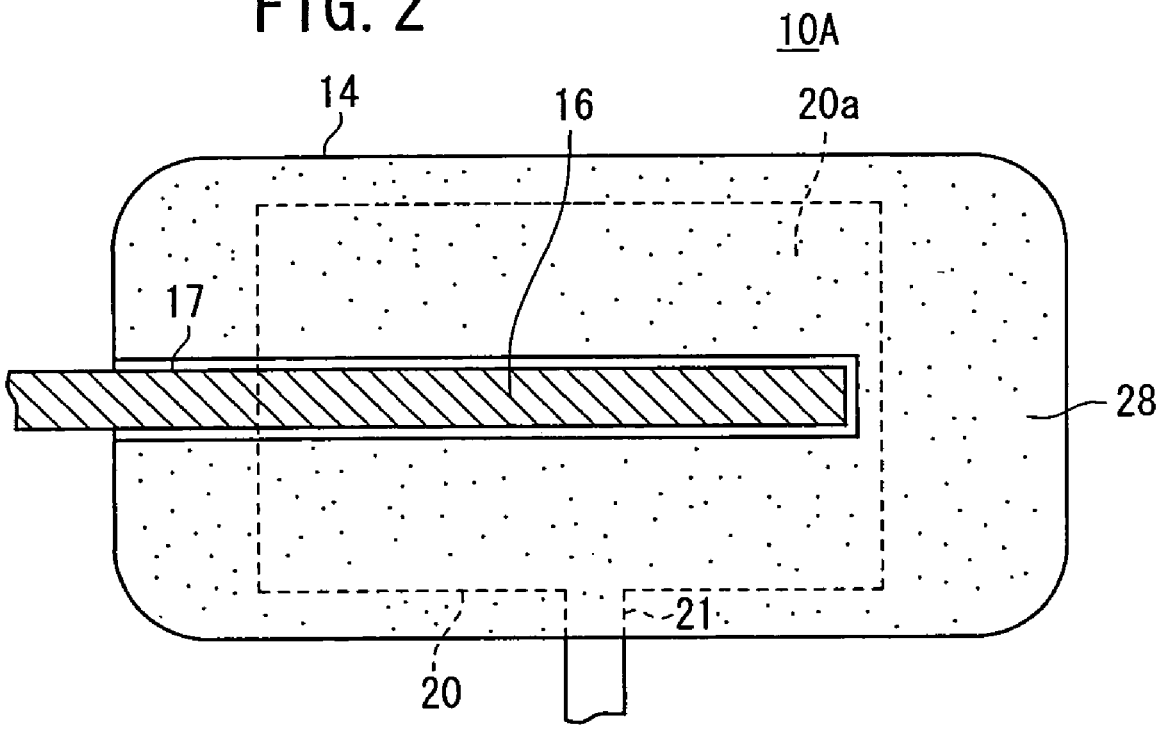
FIG. 2 is a plan view of the light emission device according to the first embodiment of the present invention.

In the embodiment shown in FIG. 1, the anode electrode 20 is connected to GND (ground) through a resistor R2, and hence is maintained at the zero potential. However, the anode electrode 20 may be maintained at a potential other than the zero potential. The drive voltage Va is applied between the cathode electrode 16 and the anode electrode 20 through, as shown in FIG. 2, a lead electrode 17 extending to the cathode electrode 16 and a lead electrode 21 extending to the anode electrode 20.

The light emission device 10A also has a fluorescent body 28 disposed on the surface of the emitter 14 out of contact with, but as closely as possible, to the cathode electrode 16.

The electron emitter 10A according to the first embodiment is placed in a vacuum space. As shown in FIG. 1, the electron emitter 10A has an electric field concentration point A. The point A can also be defined as a point including a triple point where the cathode electrode 16, the emitter 14, and the vacuum are present at one point.

The vacuum level in the atmosphere should preferably in the range from 2000 to $10^{-6}$ Pa and more preferably in the range from $10^{-3}$ to $10^{-5}$ Pa.

The reason for the above range is that in a lower vacuum in excess of 2000 Pa, many gas molecules would be present in the space, and sufficient luminance could not be achieved, and in a higher vacuum lower than $10^{-6}$ Pa, though electrons would be liable to be easily emitted from the electric field concentration point A, structural body supports and vacuum seals would be large in size, posing disadvantages on efforts to make the light emission device smaller in size.

The emitter 14 is made of a dielectric material. The dielectric material should preferably have a relatively high dielectric constant, e.g., a dielectric constant of 1000 or higher. Dielectric materials of such a nature may be ceramics including barium titanate, lead zirconate, lead magnesium niobate, lead nickel niobate, lead zinc niobate, lead manganese niobate, lead magnesium tantalate, lead nickel tantalate, lead antimony tinate, lead titanate, lead magnesium tungstenate, lead cobalt niobate, etc., ceramics containing a desired combination of these compounds, materials whose chief constituent contains 50 weight % or more of these compounds, or materials containing the above ceramics and oxides of lanthanum, calcium, strontium, molybdenum, tungsten, barium, niobium, zinc, nickel, manganese, etc., any combinations thereof, or other compounds added thereto.

For example, a two-component n-PMN-mPT compound (n, m represent molar ratios) of lead magnesium niobate (PMN) and lead titanate (PT) has its Curie point lowered and its specific dielectric constant increased at room temperature when the molar ratio of PMN is increased.

Particularly, if n=0.85–1.0, m=1.0–n, then the specific dielectric constant has a preferable value of 3000 or higher. For example, if n=0.91, m=0.09, then the specific dielectric constant of 15000 at room temperature is achieved, and if n=0.95, m=0.05, the specific dielectric constant of 20000 at room temperature is achieved.

A three-component compound of lead magnesium niobate (PMN), lead titanate (PT), and lead zirconate (PZ) may have its specific dielectric constant increased by making the compound have a composition in the vicinity of a morphotropic phase boundary (MPB) between a tetragonal system and a pseudo-cubic system or a tetragonal system and a rhombohedral system. For example, the specific dielectric constant of 5500 is achieved preferably with PMN:PT:PZ=0.375:0.375:0.25, and the specific dielectric constant of 4500 is achieved preferably with PMN:PT:PZ=0.5:0.375:0.125. It is also preferable to increase the dielectric constant by mixing the above dielectric materials with a metal such as platinum insofar as electric insulation is maintained. For example, the dielectric materials are mixed with 20 weight % of platinum.

The emitter 14 may be in the form of a piezoelectric/electrostrictive layer or an anti-ferroelectric layer. If the emitter 14 comprises a piezoelectric/electrostrictive layer, then it may be made of ceramics such as lead zirconate, lead magnesium niobate, lead nickel niobate, lead zinc niobate, lead manganese niobate, lead magnesium tantalate, lead nickel tantalate, lead antimony tinate, lead titanate, barium titanate, lead magnesium tungstenate, lead cobalt niobate, or the like. or a combination of any of these materials.

The emitter 14 may be made of chief components including 50 weight % or more of any of the above compounds. Of the above ceramics, the ceramics including lead zirconate is mostly frequently used as a constituent of the piezoelectric/electrostrictive layer of the emitter 14.

If the piezoelectric/electrostrictive layer is made of ceramics, then oxides of lanthanum, calcium, strontium, molybdenum, tungsten, barium, niobium, zinc, nickel, manganese, or the like, or a combination of these materials, or any of other compounds may be added to the ceramics.

For example, the piezoelectric/electrostrictive layer should preferably be made of ceramics including as chief components lead magnesium niobate, lead zirconate, and lead titanate, and also including lanthanum and strontium.

The piezoelectric/electrostrictive layer may be dense or porous. If the piezoelectric/electrostrictive layer is porous, then it should preferably have a porosity of 40% or less.

If the emitter 14 is in the form of an anti-ferroelectric layer, then the anti-ferroelectric layer may be made of lead zirconate as a chief component, lead zirconate and lead tin as chief components, lead zirconate with lanthanum oxide added thereto, or lead zirconate and lead tin as components with lead zirconate and lead niobate added thereto.

The anti-ferroelectric layer may be porous. If the anti-ferroelectric layer is porous, then it should preferably have a porosity of 30% or less.

If the emitter 14 is made of strontium tantalate bismuthate, then its polarization reversal fatigue is small. Materials whose polarization reversal fatigue is small are laminar ferroelectric compounds and expressed by the general formula of $(BiO_2)^{2+}(A_{m-1}B_mO_{3m+1})^{2-}$. Ions of the metal A are $Ca^{2+}$, $Sr^{2+}$, $Ba^{2+}$, $Pb^{2+}$, $Bi^{3+}$, $La^{3+}$, etc., and ions of the metal B are $Ti^{4+}$, $Ta^{5+}$, $Nb^{5+}$, etc.

The baking temperature can be lowered by adding glass such as lead borosilicate glass or the like or other compounds of low melting point (e.g., bismuth oxide or the like) to the piezoelectric/electrostrictive/ceramics.

If the emitter 14 is made of a material having a high melting point or a high evaporation temperature, such as a non-lead material, then it is less liable to be damaged by the impingement of electrons or ions.

The magnitude of the thickness h (see FIG. 1) of the emitter 14 between the cathode electrode 16 and the anode electrode 20 will be described below. If the voltage between the cathode electrode 16 and the anode electrode 20, i.e., the voltage appearing between the cathode electrode 16 and the anode electrode 20 when the drive voltage Va outputted from the pulse generation source 22 is applied between the cathode electrode 16 and the anode electrode 20, is Vak, then the thickness h should preferably be set in order to reverse or change the polarization in an electric field E expressed by E=Vak/h. That is, as the thickness h is smaller, the polarization can be reversed or changed at a lower voltage, so that the light emission device is capable of emitting electrons at a lower drive voltage of 100 V or less.

The cathode electrode 16 is made of materials to be described below. The cathode electrode 16 should preferably be made of a conductor having a small sputtering yield and a high evaporation temperature in vacuum. For example, materials having a sputtering yield of 2.0 or less at 600 V in $Ar^+$ and an evaporation temperature of 1800 K or higher at an evaporation pressure of $1.3\times10^{-3}$ Pa are preferable. Such materials include platinum, molybdenum, tungsten, etc. The cathode electrode 16 may be made of a conductor which is resistant to a high-temperature oxidizing atmosphere, e.g., a metal, an alloy, a mixture of insulative ceramics and a metal, or a mixture of insulative ceramics and an alloy. Preferably, the cathode electrode 16 should be chiefly composed of a precious metal having a high melting point, e.g., platinum, iridium, palladium, rhodium, molybdenum, or the like, or an alloy of silver and palladium, silver and platinum, platinum and palladium, or the like, or a cermet of platinum and ceramics. Further preferably, the cathode electrode 16 should be made of platinum only or a material chiefly composed of a platinum-base alloy. The cathode electrode 16 should also preferably be made of carbon or a graphite-base material, e.g., diamond thin film, diamond-like carbon, or carbon nanotube. Ceramics to be added to the electrode material should preferably have a proportion ranging from 5 to 30 volume %.

Furthermore, a material such as an organic metal paste which can produce a thin film after being baked, e.g., a platinum resinate paste or the like, should preferably be used. An oxide electrode for suppressing a polarization reversal fatigue, which is made of ruthenium oxide, iridium oxide, strontium ruthenate, $La_{1-x}Sr_xCoO_3$ (e.g., x=0.3 or 0.5), $La_{1-x}Ca_xMnO_3$, $La_{1-x}Ca_xMn_{1-y}Co_yO_3$ (e.g., x=0.2, y=0.05), or a mixture of any one of these compounds and a platinum resinate paste, for example, is preferable.

The cathode electrode 16 may be made of any of the above materials by any of thick-film forming processes including screen printing, spray coating, coating, dipping, electrophoresis, etc., or any of various thin-film forming processes including sputtering, an ion beam process, vacuum evaporation, ion plating, chemical vapor deposition (CVD), plating, etc. Preferably, the cathode electrode 16 is made by any of the above thick-film forming processes.

The cathode electrode 16 has a thickness tc (see FIG. 1) of 20 μm or less and preferably 5 μm or less. Therefore, the thickness tc of the cathode electrode 16 may be 100 nm or less. If the thickness tc of the cathode electrode 16 is very thin (10 nm or less), then electrons are emitted from the interface between the cathode electrode 16 and the emitter 14, so that the electron emission efficiency can be increased furthermore.

The anode electrode 20 is made of the same material by the same process as the cathode electrode 16. Preferably, the anode electrode 20 is made by any of the above thick-film forming processes. The anode electrode 20 has a thickness of 20 μm or less and preferably 5 μm or less.

Each time the emitter 14, the cathode electrode 16, or the anode electrode 20 is formed, the assembly may be heated (sintered) into an integral structure. Depending on the process by which the cathode electrode 16 and the anode electrode 20 are formed, they may not be heated (sintered) so as to be integrally combined.

The sintering process for integrally combining the emitter 14, the cathode electrode 16, and the anode electrode 20 may be carried out at a temperature ranging from 500 to 1400° C., preferably from 1000 to 1400° C. For heating the emitter 14 which is in the form of a film, the emitter 14 should be sintered together with its evaporation source while their atmosphere is being controlled, so that the composition of the emitter 14 will not become unstable at the high temperature.

The emitter 14 may be covered with an appropriate member for concealing the surface thereof against direct exposure to the sintering atmosphere when the emitter 14 is sintered.

The cathode electrode 16 as viewed in plan has a projected shape which is a slender rectangular shape as shown in FIG. 2. The cathode electrode 16 is shaped such that its outer peripheral edge confronts the inner peripheral edge of the fluorescent body 28, i.e., the outer peripheral edge of the cathode electrode 16 is surrounded by the fluorescent body 28. The anode electrode 20 as viewed in plan has a projected shape which is an elongate rectangular shape whose area is greater than the cathode electrode 16, such that the projected shape of the cathode electrode 16 is fully contained in the projected shape of the anode electrode 20.

Specifically, the projected shape of the anode electrode 20 has a protruding portion 20*a* which protrudes out of the projected shape of the cathode electrode 16. The protruding portions 20*a* has a maximum length that should preferably range from 1 μm to 500 μm.

With this structure, the portion of the emitter 14 which corresponds to the protruding portion 20*a* of the anode electrode 20 can have its polarization reversed or changed easily. Since the electric field is concentrated from the protruding portion 20*a* toward the peripheral edge of the cathode electrode 16, electrons can easily be emitted from around the triple point on the cathode electrode 16.

Because the projected shape of the cathode electrode 16 is fully contained in the projected shape of the anode electrode 20, the outer peripheral portion of the cathode electrode 16 contributes to the emission of electrons, thus increasing the amount of emitted light. By appropriately selecting the area of the cathode electrode 16 and the projected shape thereof as viewed in plan, the amount of emitted light and the electrostatic capacitance between the cathode electrode 16 and the anode electrode 20 can be optimized for reducing the power consumption and increasing the amount of emitted light.

Figure 3:
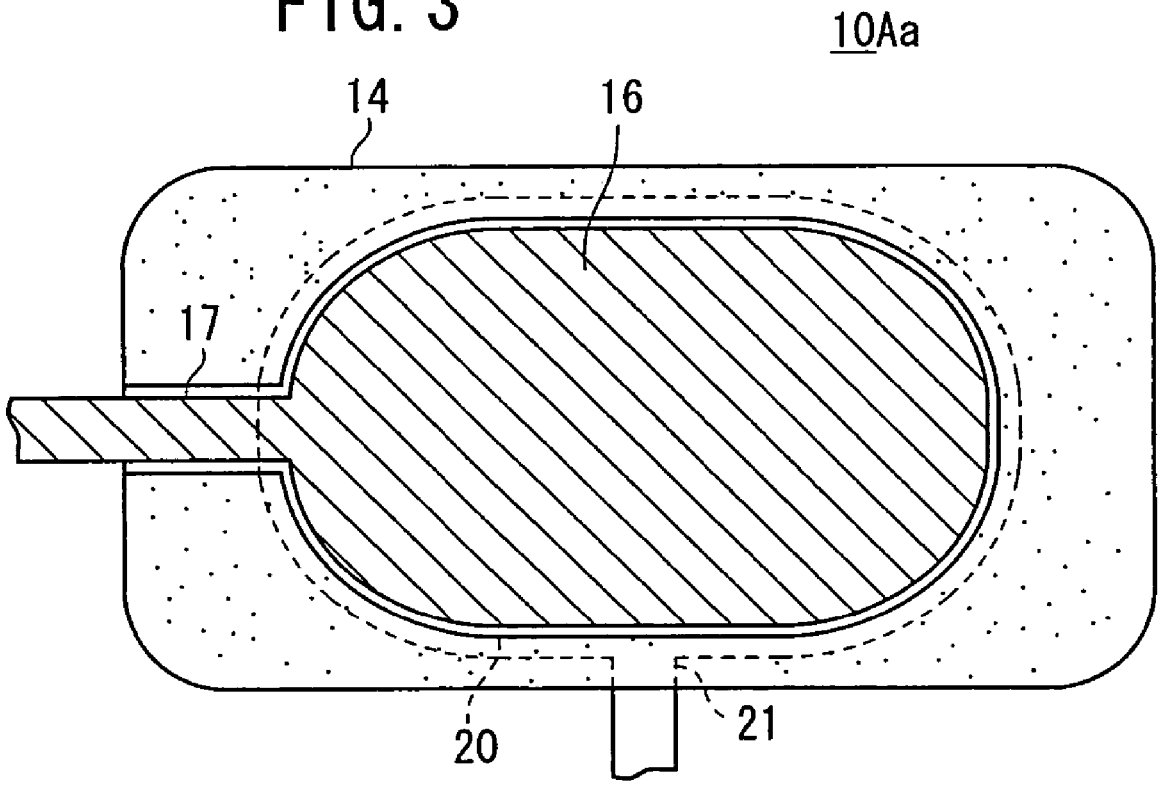
FIG. 3 is a plan view of electrodes of a first modification of the light emission device according to the first embodiment of the present invention.

The projected shapes as viewed in plan of the cathode electrode 16 and the anode electrode 20 may be an elliptical shape as with a light emission device 10Aa according to a first modification as shown in FIG. 3. In FIG. 3, the projected shapes of the cathode electrode 16 and the anode electrode 20 are similar to each other.

Figure 4:
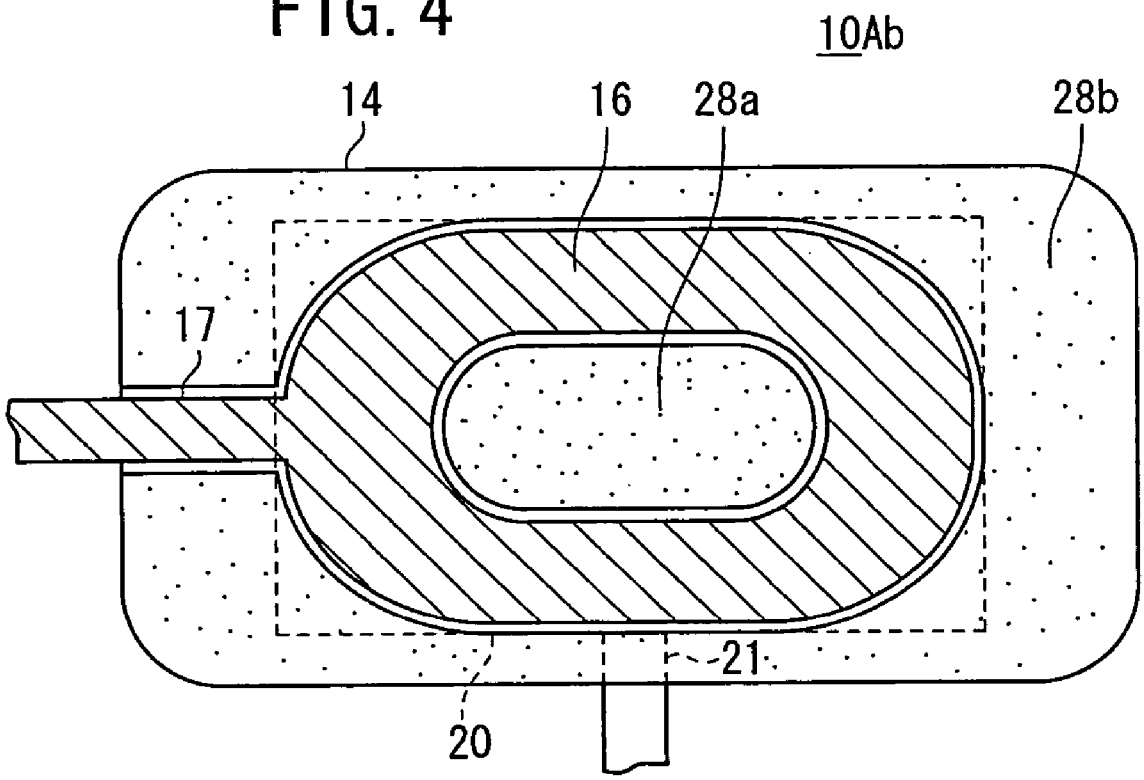
FIG. 4 is a plan view of electrodes of a second modification of the light emission device according to the first embodiment of the present invention.

A light emission device 10Ab according to a second modification as shown in FIG. 4 has a cathode electrode 16 having a ring-like projected shape and an anode electrode 20 having an elongate rectangular projected shape. The cathode electrode 16 surrounds the outer peripheral edge of a central fluorescent body 28*a*, and an outer fluorescent body 28*b* surrounds the outer peripheral edge of the cathode electrode 16. Therefore, the triple point where the cathode electrode 16, the emitter 14, and the vacuum are present, i.e., the electric field concentration point A, is present on not only the outer periphery, but also the inner periphery, of the cathode electrode 16 for an increased electron emission efficiency.

Figure 5:
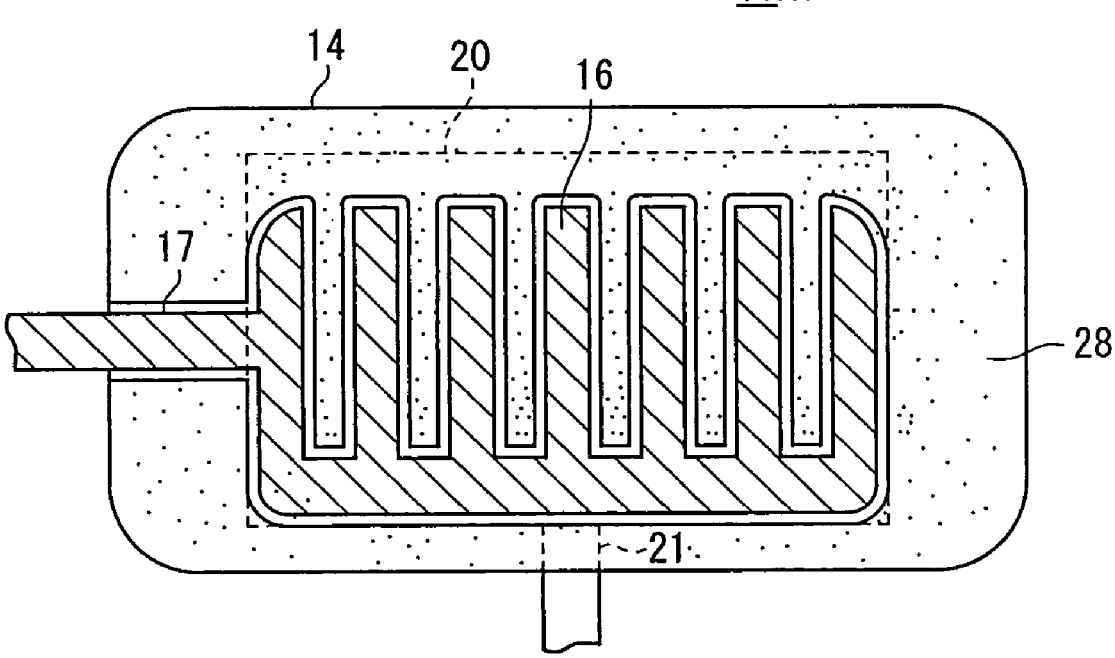
FIG. 5 is a plan view of electrodes of a third modification of the light emission device according to the first embodiment of the present invention.

A light emission device 10Ac according to a third modification as shown in FIG. 5 has a cathode electrode 16 having a comb-toothed projected shape and an anode electrode 20 having an elongate rectangular projected shape. With this structure, the length of the outer periphery of the cathode electrode 16 where the triple point of the cathode electrode 16, the emitter 14, and the vacuum is present is greatly increased without changing the overall size of the cathode electrode 16, for increasing the electron emission efficiency and easily optimizing the electrostatic capacitance and power consumption.

Figure 6:
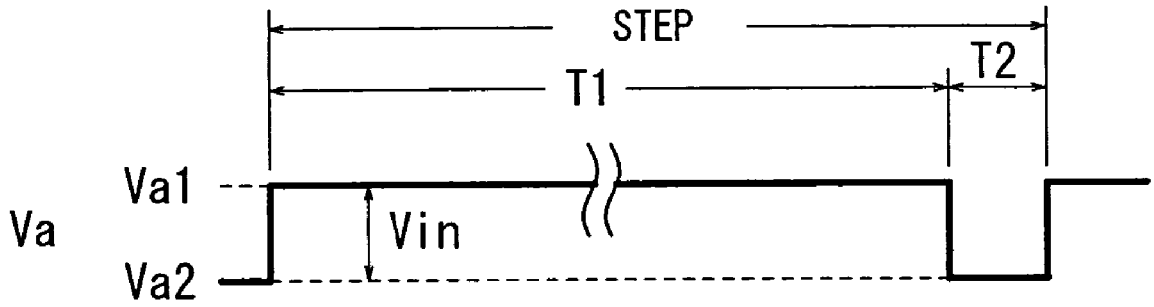
FIG. 6 is a diagram showing the waveform of a drive voltage that is outputted from a pulse generation source.

A process of driving the light emission device 10A will be described below with reference to FIGS. 1, 6 through 9. As shown in FIG. 6, the drive voltage Va outputted from the pulse generation source 22 has the waveform of alternatingcurrent pulses in the form of repeated steps each including a period in which a first voltage Va1 is outputted (preparatory period T1) and a period in which a second voltage Va2 is outputted (electron emission period T2). The first voltage Va1 is a voltage that makes the potential of the cathode electrode 16 higher than the potential of the anode electrode 20, and the second voltage Va2 is a voltage that makes the potential of the cathode electrode 16 lower than the potential of the anode electrode 20. The drive voltage Va has an amplitude Vin that can be defined by a value produced by subtracting the second voltage Va2 from the first voltage Va1 (=Va1−Va2).

Figure 7:
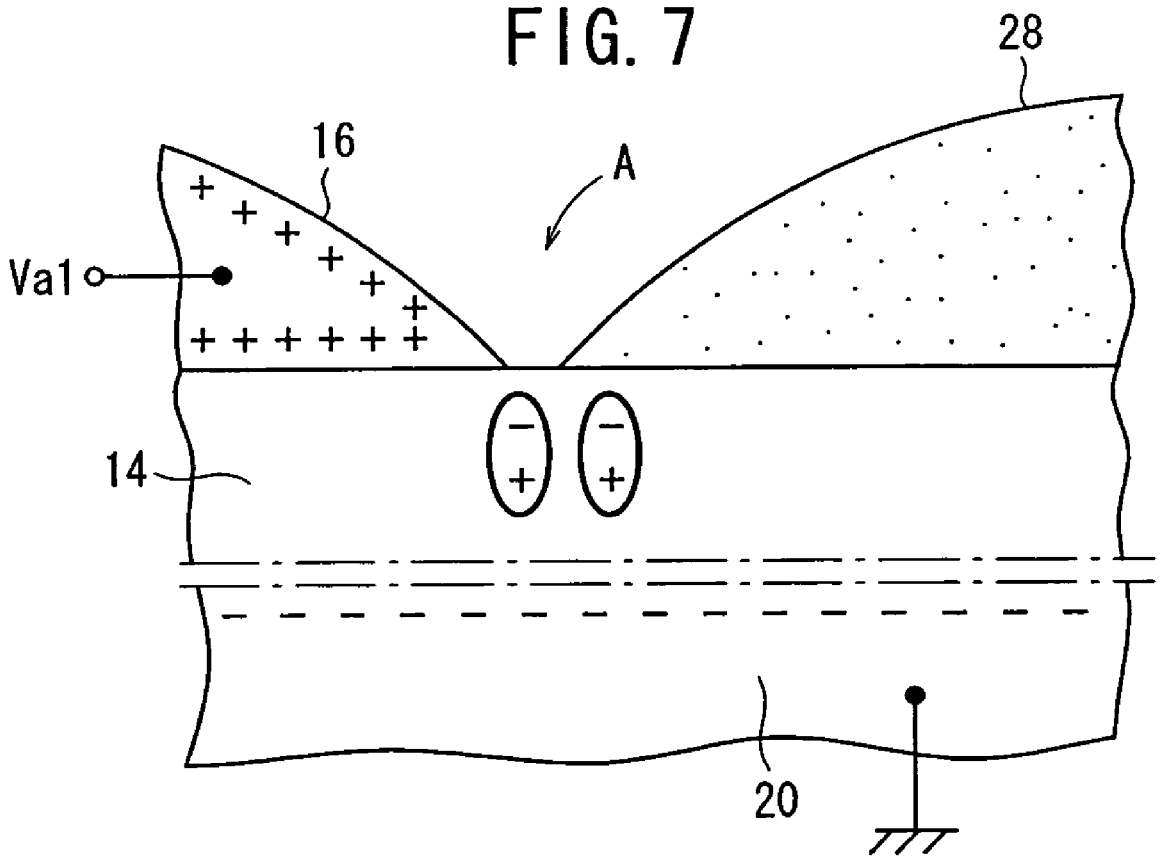
FIG. 7 is a view showing the manner in which the light emission device according to the first embodiment operates when a first voltage is applied thereto.

As shown in FIG. 7, the preparatory period T1 is a period in which the first voltage Va1 is applied between the cathode electrode 16 and the anode electrode 20 to polarize the emitter 14. The first voltage Va1 may be a DC voltage, as shown in FIG. 6, but may be a single pulse voltage or a succession of pulse voltages. The preparatory period T1 should preferably be longer than the electron emission period T2 for sufficiently polarizing the emitter 14. For example, the preparatory period T1 should preferably be 100 μsec. or longer because the absolute value of the first voltage Va1 for polarizing the emitter 14 is set to a smaller value than the absolute value of the second voltage Va2 for the purpose of reducing the power consumption when the first voltage Va1 is applied and preventing damage to the cathode electrode 16.

The first voltage Va1 and the second voltage Va2 should preferably be of voltage levels for reliably polarizing the emitter 14 into positive and negative poles. For example, if the dielectric material of the emitter 14 has a coercive voltage, then the absolute values of the first voltage Va1 and the second voltage Va2 should preferably be higher than the coercive voltage.

Figure 8:
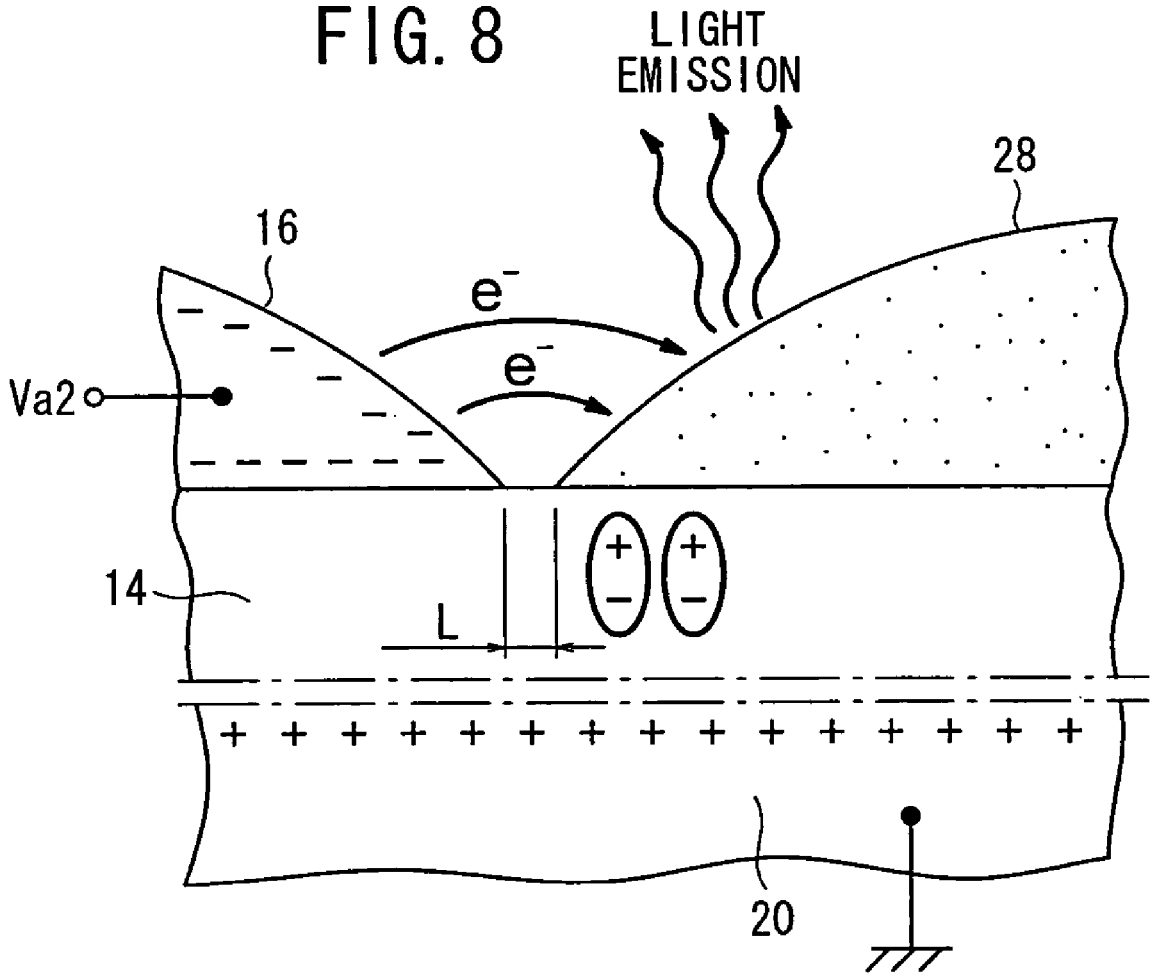
FIG. 8 is a view showing the manner in which light is emitted from a fluorescent body when primary electrons directly impinge upon the fluorescent body in the light emission device according to the first embodiment.

The electron emission period T2 is a period in which the second voltage Va2 is applied between the cathode electrode 16 and the anode electrode 20. When the second voltage Va2 is applied between the cathode electrode 16 and the anode electrode 20, the polarization of at least a portion of the emitter 14 is reversed or changed, as shown in FIG. 8. The portion of the emitter 14 where the polarization is reversed or changed includes not only a portion directly below the cathode electrode 16, but also a portion having an exposed surface with no cathode electrode 16 thereon, in the vicinity of the cathode electrode 16.

Specifically, the portion of the emitter 14 which as an exposed surface in the vicinity of the cathode electrode 16 has its polarization seeping out. Because of the reversed or changed polarization, a locally concentrated electric field is produced in the cathode electrode 16 and the positive poles of dipole moments in the vicinity of the cathode electrode 16, causing the cathode electrode 16 to emit primary electrons.

As shown in FIG. 8, if the distance L between the outer peripheral edge of the cathode electrode 16 and the inner peripheral edge of the fluorescent body 28, which confront each other, is small, then primary electrons discharged from the cathode electrode 16 directly impinge upon the fluorescent body 28, exciting the fluorescent body 28 to emit fluorescent light. If the thickness of the cathode electrode 16 is very small (up to 10 nm), then electrons are discharged from the interface between the cathode electrode 16 and the emitter 14, and the discharged electrons directly impinge upon the fluorescent body 28, exciting the fluorescent body 28.

Figure 9:
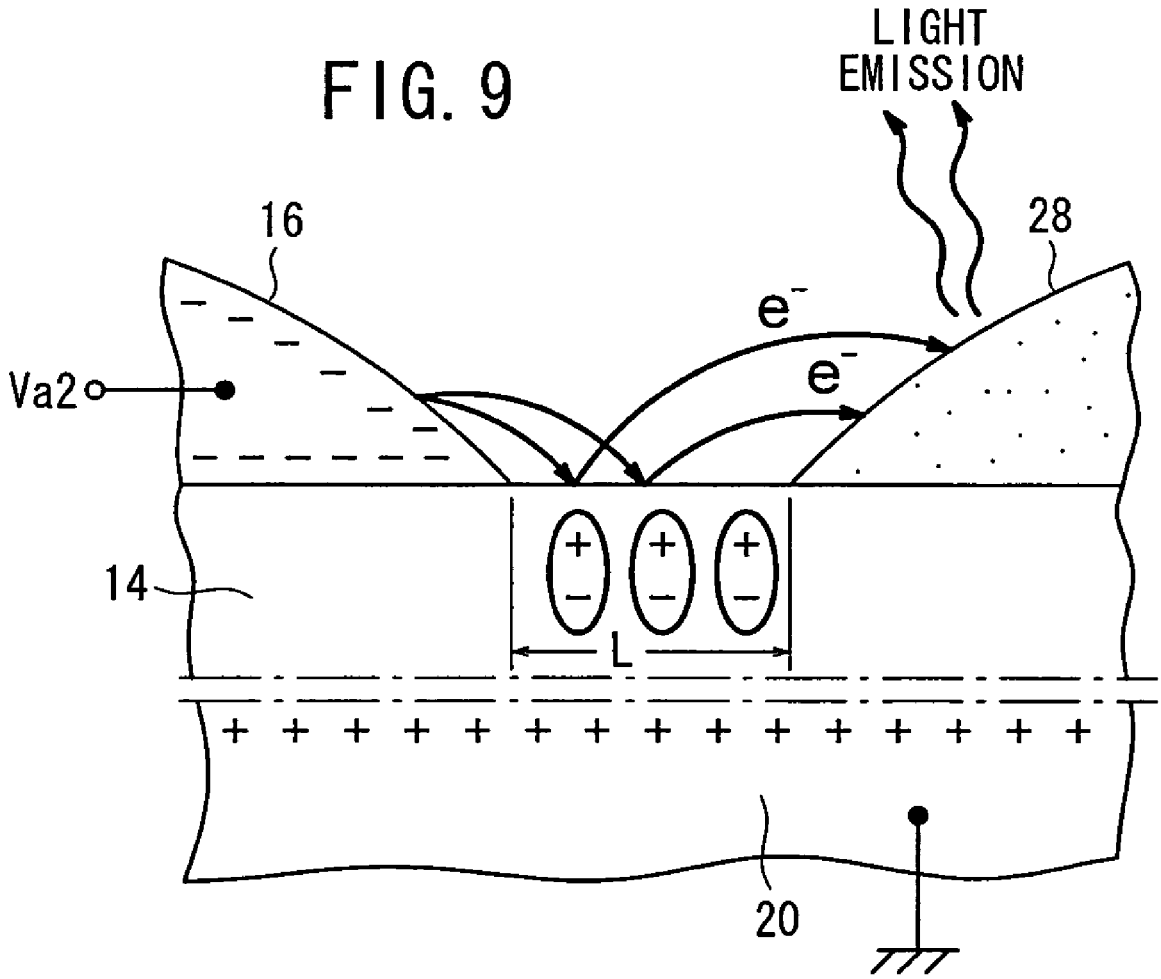
FIG. 9 is a view showing the manner in which light is emitted from the fluorescent body when reflected electrons impinge upon the fluorescent body in the light emission device according to the first embodiment.

As shown in FIG. 9, if the distance L between the outer peripheral edge of the cathode electrode 16 and the inner peripheral edge of the fluorescent body 28, which confront each other, is large, then when the second voltage Va2 is applied between the cathode electrode 16 and the anode electrode 20, primary electrons discharged from the cathode electrode 16 are reflected by the surface of the emitter 14 and impinge as reflected electrons upon the fluorescent body 28, exciting the fluorescent body 28 to emit fluorescent light. At this time, not all the discharged primary electrons become reflected electrons, but some primary electrons may directly impinge upon the fluorescent body 28, exciting the fluorescent body 28.

In addition, primary electrons may impinge upon the emitter 14, causing the emitter 14 to discharge secondary electrons. The discharged secondary electrons may be accelerated by an electric field generated in the vicinity of the surface of the cathode electrode 16 and impinge upon the fluorescent body 28, exciting the fluorescent body 28.

When electrons discharged from the emitter 14 impinge again upon the emitter 14, or when ionization occurs in the vicinity of the surface of the emitter 14, the emitter 14 may be damaged or crystalline defects may be induced, tending to make the emitter 14 weak structurally.

It is therefore preferable to construct the emitter 14 of a dielectric material having a high evaporation temperature in vacuum, e.g., $BaTiO_3$ or the like which does not contain Pb. The emitter 14 thus constructed has its constituent atoms less liable to evaporate due to the Joule heat, obstructing the promotion of ionization by electrons. This is effective in protecting the surface of the emitter 14.

With the light emission device 10A according to the first embodiment, electrons discharged from the cathode electrode 16 impinge upon the fluorescent body 28 disposed in the vicinity of the cathode electrode 16, exciting the fluorescent body 28 to emit light.

Therefore, the light emission device 10A does not need to have a collector electrode. As a result, the light emission device 10A may be low in profile, lightweight, and low in cost.

Inasmuch as the distance from the electron emission region of the cathode electrode 16 to the fluorescent body 28 is short, almost all of the discharged electrons can reach the fluorescent body 28 without impinging upon gas molecules even when the vacuum atmosphere has a low vacuum level of 2000 Pa. Thus, a number of electrons that impinge upon the fluorescent body 28 which are required to achieve a desired luminance level of light emission can be maintained. A higher vacuum level of $10^{-3}$ Pa or less is preferable for higher luminance.

The gas and atoms that are produced when part of the emitter 14 is evaporated are floating in the vicinity of the emitter 14. If a collector electrode were present, then when the discharged electrodes travel toward the collector electrode, the electrons would ionize the gas and the atoms into positive ions and electrons. Since the electrons thus generated by the ionization would further ionize the gas and the atoms, electrons are exponentially multiplied to generate a local plasma in which the electrons and the positive ions are neutrally present. The generated positive ions would impinge upon the emitter 14 and the cathode electrode 16, tending to damage the emitter 14 and the cathode electrode 16 (ion bombardment phenomenon).

According to the first embodiment, however, inasmuch as there is no collector electrode and the distance that the discharged electrons are accelerated and fly is small, the discharged electrons do not substantially ionize the gas present in the vicinity of the emitter 14 or atoms of the emitter 14 into positive ions and electrons. As a result, the number of areas where positive ions are generated in the vacuum atmosphere is reduced, and the problem of damage caused to the emitter 14 and the cathode electrode 16 by the ion bombardment phenomenon is avoided.

If a plurality of light emission devices 10A are arrayed into a single display, then since the distance from the electron emission region of the cathode electrode 16 to the fluorescent body 28 is short and the distance that the discharged electrons are accelerated and fly is small in each of the light emission devices 10A, electrons emitted from each of the light emission devices 10A do not impinge upon the fluorescent bodies of adjacent light emission devices 10A, and hence there is no crosstalk between the light emission devices.

In the above display, one or more spacers may be interposed between the light emission devices 10A and a display panel in order to keep rigid the display including the display panel and to maintain the gap between the light emission devices 10A and the display panel at a predetermined distance. In this arrangement, the spacer or spacers are not charged because electrons emitted from the light emission devices 10A do not fly to the spacer. Even if the spacer is charged for some reasons, producing an unwanted field distribution between the light emission devices 10A and the spacer, the electrons are not affected by the unwanted field distribution because the distance that the discharged electrons are accelerated and fly is small.

With the light emission device 10A according to the first embodiment, therefore, electrons discharged from the cathode electrode 16 are caused to impinge upon the fluorescent body 28 without using a collector electrode, exciting the fluorescent body 28 to emit light. The light emission device 10A can effectively be rendered small in size, lightweight, and low in cost.

A light emission device 10B according to a second embodiment of the present invention will be described below with reference to FIGS. 10 through 15D.

Figure 10:
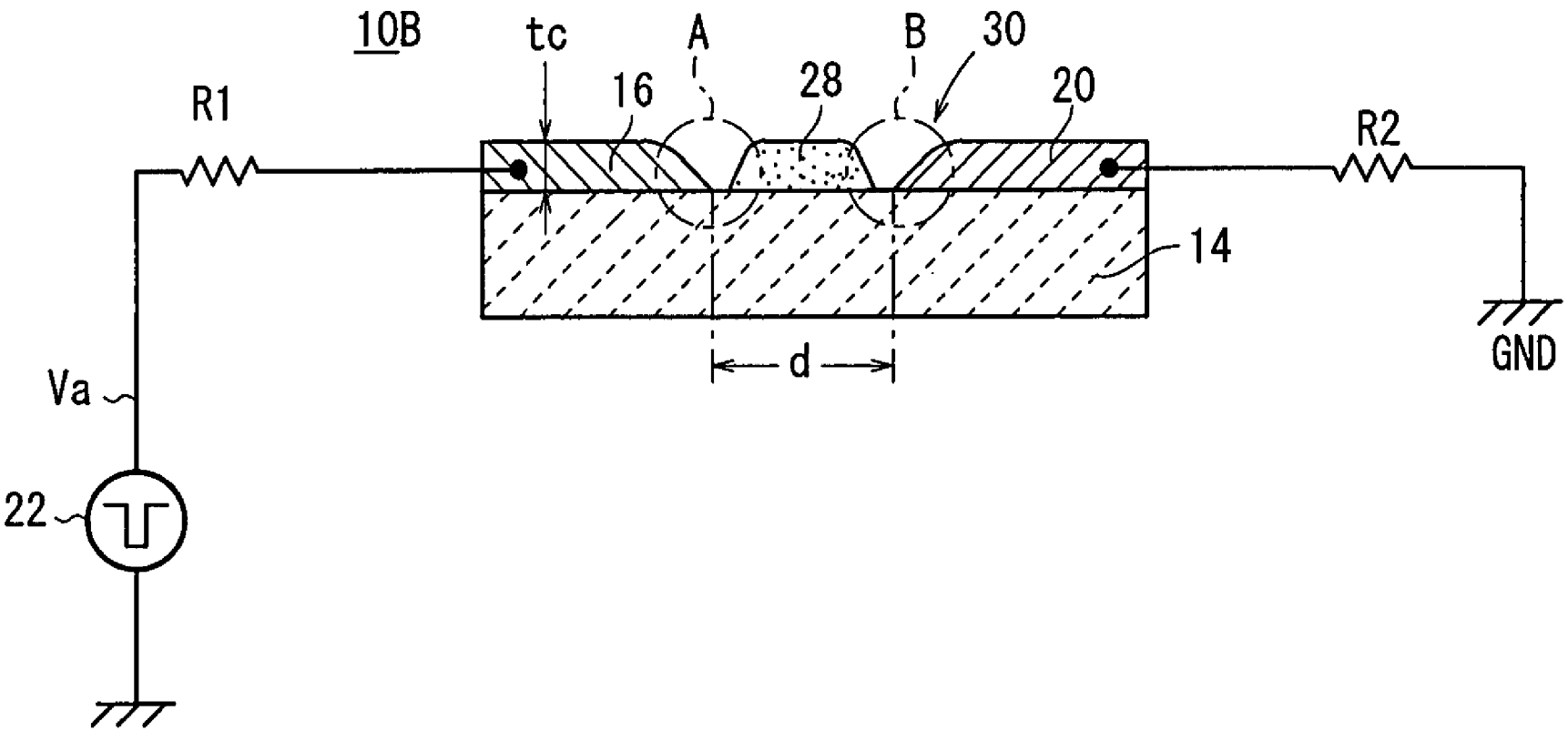
FIG. 10 is a view of a light emission device according to a second embodiment of the present invention, the view being illustrative of a first process of driving the light emission device according to the second embodiment.
Figure 11:
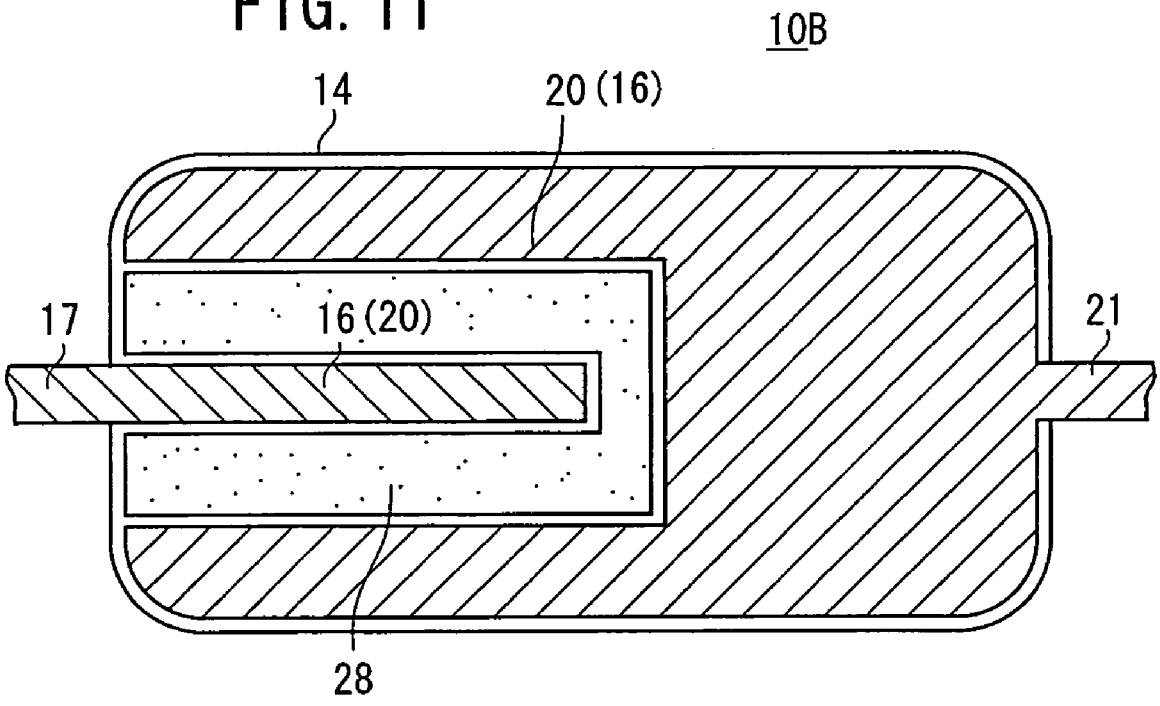
FIG. 11 is a plan view of the light emission device according to the second embodiment of the present invention.

As shown in FIGS. 10 and 11, the light emission device 10B according to the second embodiment is substantially similar in structure to the light emission device 10A according to the first embodiment, but differs therefrom in that the cathode electrode 16 and the anode electrode 20 are disposed in contact with a principal surface of the emitter 14, with a slit 30 defined between the cathode electrode 16 and the anode electrode 20, and the fluorescent body 28 is disposed in at least the slit 30. The emitter 14 has portions exposed between the cathode electrode 16 and the fluorescent body 28 and between the anode electrode 20 and the fluorescent body 28. According to the second embodiment, the light emission device 10A has an electric field concentration point B made up of the anode electrode 20, the emitter 14, and the vacuum, in addition to the electric field concentration point A.

According to the second embodiment, as shown in FIG. 11, the outer peripheral edge of the cathode electrode 16 and the inner peripheral edge of the fluorescent body 28 face each other, i.e., the outer peripheral edge of the cathode electrode 16 is surrounded by the fluorescent body 28, and the outer peripheral edge of the fluorescent body 28 and the inner peripheral edge of the anode electrode 20 face each other, i.e., the outer peripheral edge of the fluorescent body 28 is surrounded by the anode electrode 20.

In FIG. 11, as indicated by the reference numerals in parentheses, the outer peripheral edge of the anode electrode 20 and the inner peripheral edge of the fluorescent body 28 may face each other, i.e., the outer peripheral edge of the anode electrode 20 may be surrounded by the fluorescent body 28, and the outer peripheral edge of the fluorescent body 28 and the inner peripheral edge of the cathode electrode 16 may face each other, i.e., the outer peripheral edge of the fluorescent body 28 may be surrounded by the cathode electrode 16.

The magnitude of the width d (see FIG. 10) of the slit between the cathode electrode 16 and the anode electrode 20 will be described below. If the voltage between the cathode electrode 16 and the anode electrode 20 is Vak, then the width d should preferably be set in order to reverse or change the polarization in an electric field E expressed by E=Vak/d. That is, as the width d is smaller, the polarization can be reversed or changed at a lower voltage, so that the light emission device is capable of emitting electrons at a lower drive voltage of 100 V or less.

A first process of driving the light emission device 10B will be described below with reference to FIGS. 6, 7, 10, 12, and 13. According to the second embodiment, as with the first embodiment, as shown in FIG. 6, a step including a period in which the first voltage Va1 is outputted (preparatory period T1) and a period in which the second voltage Va2 is outputted (electron emission period T2) is repeated.

In the preparatory period T1, as shown in FIG. 7, the first voltage Va1 is applied between the cathode electrode 16 and the anode electrode 20 to polarize the emitter 14 in one direction.

Figure 12:
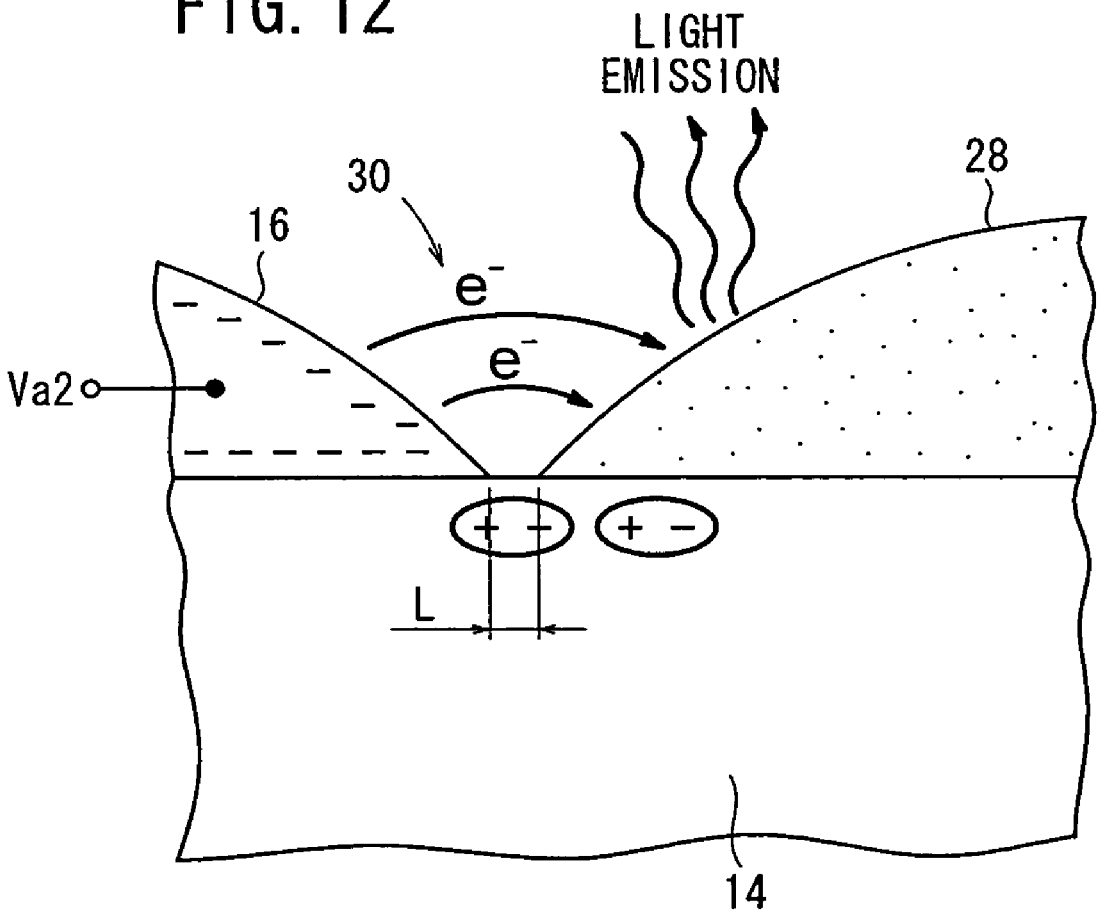
FIG. 12 is a view showing the manner in which light is emitted from a fluorescent body when primary electrons directly impinge upon the fluorescent body in the light emission device according to the second embodiment.

Subsequently, in the electron emission period T2, the second voltage Va2 is applied between the cathode electrode 16 and the anode electrode 20 to reverse the polarization of at least a portion (corresponding to the slit 30) of the emitter 14, as shown in FIG. 12. Because of the reversed polarization, a locally concentrated electric field is produced in the cathode electrode 16 and the positive poles of dipole moments in the vicinity of the cathode electrode 16, causing the cathode electrode 16 to emit primary electrons.

As shown in FIG. 12, if the distance L between the outer peripheral edge of the cathode electrode 16 and the inner peripheral edge of the fluorescent body 28, which confront each other, is small, then primary electrons discharged from the cathode electrode 16 directly impinge upon the fluorescent body 28, exciting the fluorescent body 28 to emit fluorescent light. If the thickness of the cathode electrode 16 is very small (up to 10 nm), then electrons are discharged from the interface between the cathode electrode 16 and the emitter 14, and the discharged electrons directly impinge upon the fluorescent body 28, exciting the fluorescent body 28.

Figure 13:
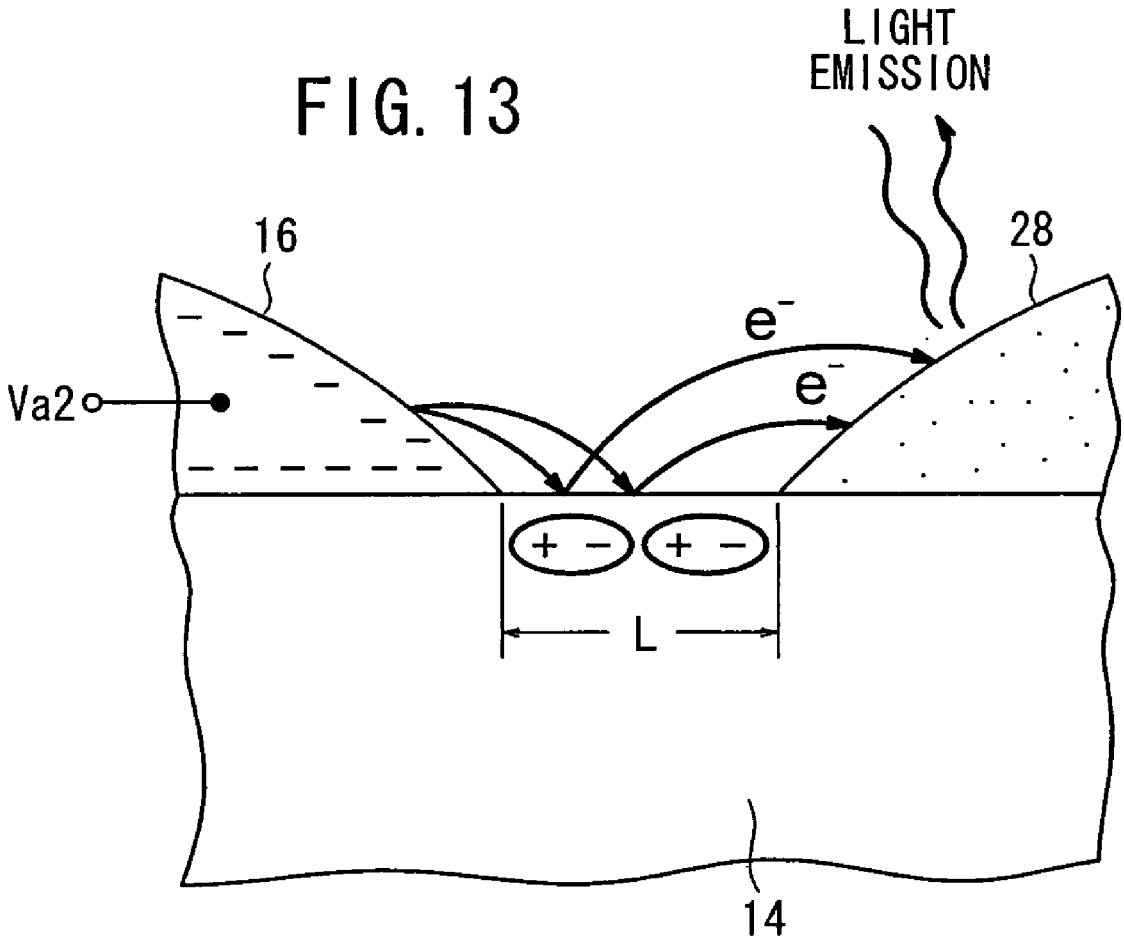
FIG. 13 is a view showing the manner in which light is emitted from the fluorescent body when reflected electrons impinge upon the fluorescent body in the light emission device according to the second embodiment.

As shown in FIG. 13, if the distance L between the outer peripheral edge of the cathode electrode 16 and the inner peripheral edge of the fluorescent body 28, which confront each other, is large, then when the second voltage Va2 is applied between the cathode electrode 16 and the anode electrode 20, primary electrons discharged from the cathode electrode 16 are reflected by the surface of the emitter 14 and impinge as reflected electrons upon the fluorescent body 28, exciting the fluorescent body 28 to emit fluorescent light. At this time, not all the discharged primary electrons become reflected electrons, but some primary electrons may directly impinge upon the fluorescent body 28, exciting the fluorescent body 28.

In addition, primary electrons may impinge upon the emitter 14, causing the emitter 14 to discharge secondary electrons. The discharged secondary electrons may be accelerated by an electric field generated in the vicinity of the surface of the cathode electrode 16 and impinge upon the fluorescent body 28, exciting the fluorescent body 28.

Figure 14:
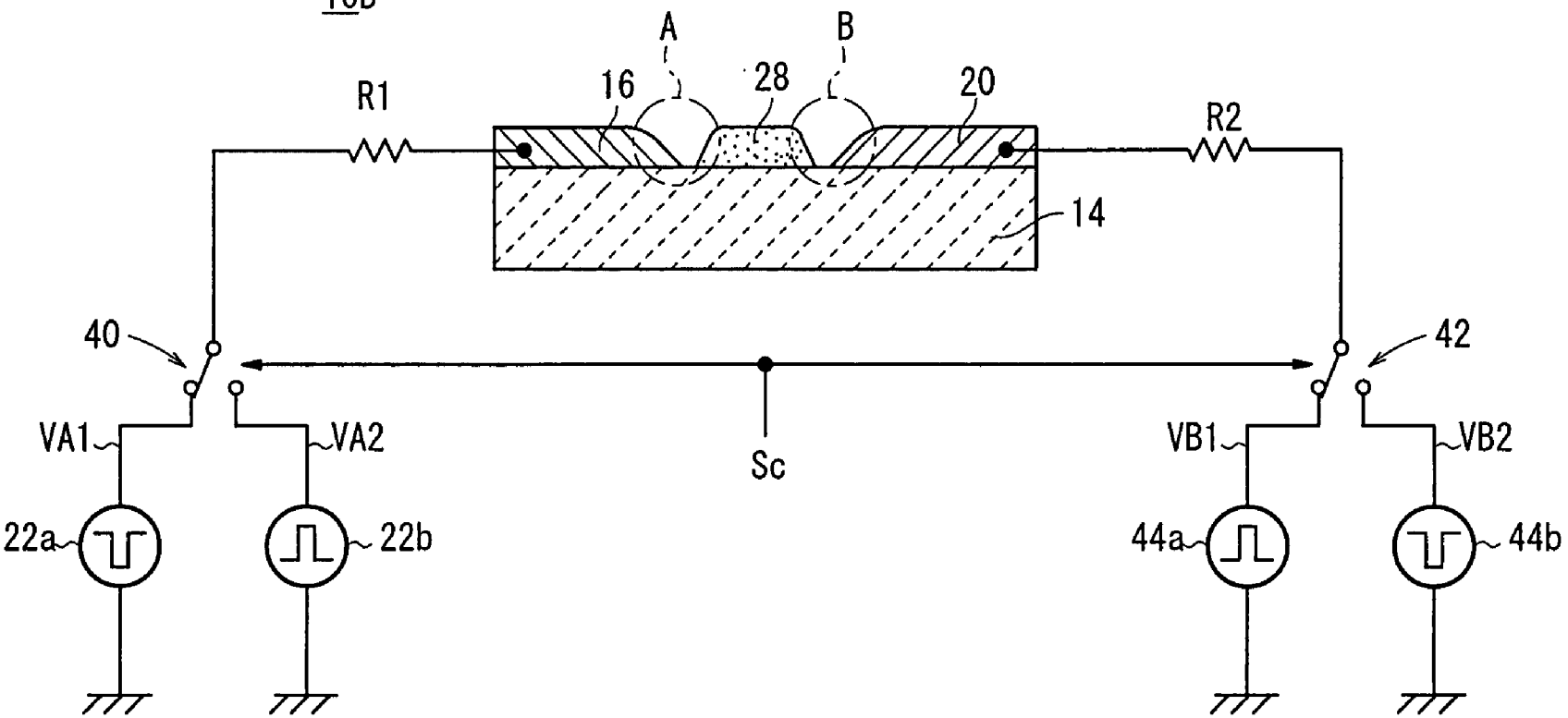
FIG. 14 is a view of the light emission device according to the second embodiment of the present invention, the view being illustrative of a second process of driving the light emission device according to the second embodiment.

A second process of driving the light emission device 10B will be described below with reference to FIGS. 14 through 15D. The second driving process is different from the first driving process as follows:

(1) The light emission device 10B has two pulse generation sources (first and second pulse generation sources 22*a*, 22*b*) for applying a drive voltage between the cathode electrode 16 and ground (GND). (2) The light emission device 10B has a first switching circuit 40 for alternately selecting the first and second pulse generation sources 22*a*, 22*b* based on a switching control signal Sc. (3) The light emission device 10B has two pulse generation sources (first and second pulse generation sources 44*a*, 44*b*) for applying a drive voltage between the anode electrode 20 and ground (GND). (4) The light emission device 10B has a second switching circuit 42 for alternately selecting the first and second pulse generation sources 44*a*, 44*b* based on the switching control signal Sc.

Figure 15A:
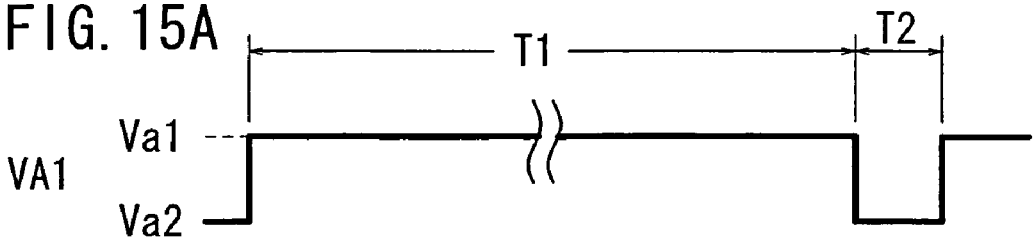
FIG. 15A is a diagram showing the waveform of a drive voltage that is outputted from a first pulse generation source.

As shown in FIG. 15A, a drive voltage VA1 outputted from the first pulse generation source 22*a* has a voltage waveform such that the first voltage Va1 (e.g., 30 V) is applied between the cathode electrode 16 and GND in the preparatory period T1 and the second voltage Va2 (e.g., −100 V) applied between the cathode electrode 16 and GND in the electron emission period T2.

Figure 15B:
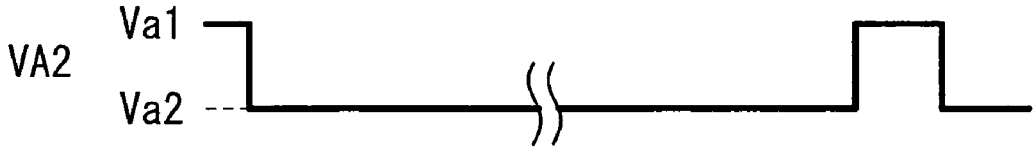
FIG. 15B is a diagram showing the waveform of a drive voltage that is outputted from a second pulse generation source.

As shown in FIG. 15B, a drive voltage VA2 outputted from the second pulse generation source 22*b* has a voltage waveform such that the second voltage Va2 (e.g., −100 V) is applied between the cathode electrode 16 and GND in the preparatory period T1 and the first voltage Va1 (e.g., 30 V) applied between the cathode electrode 16 and GND in the electron emission period T2.

Figure 15C:
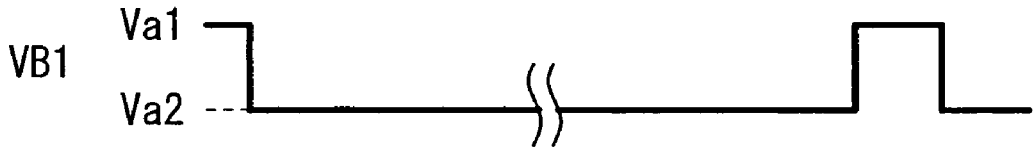
FIG. 15C is a diagram showing the waveform of a drive voltage that is outputted from a first pulse generation circuit.

As shown in FIG. 15C, a drive voltage VB1 outputted from the first pulse generation source 44*a* has a voltage waveform such that the second voltage Va2 (e.g., −100 V) is applied between the anode electrode 20 and GND in the preparatory period T1 and the first voltage Va1 (e.g., 30 V) applied between the anode electrode 20 and GND in the electron emission period T2.

Figure 15D:
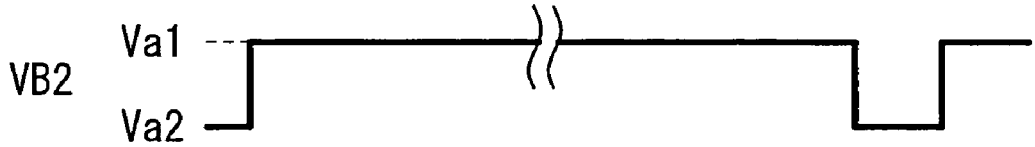
FIG. 15D is a diagram showing the waveform of a drive voltage that is outputted from a second pulse generation circuit.

As shown in FIG. 15D, a drive voltage VB2 outputted from the second pulse generation source 22*b* has a voltage waveform such that the first voltage Va1 (e.g., 30 V) is applied between the anode electrode 16 and GND in the preparatory period T1 and the second voltage Va2 (e.g., −100 V) applied between the anode electrode 20 and GND in the electron emission period T2.

The first and second switching circuits 40, 42 are ganged switching circuits having respective switches operable by the single switch control signal Sc. The switch control signal Sc may be a command signal from a computer or a timer (not shown). In the embodiment shown in FIG. 14, the first and second switching circuits 40, 42 are operated based on the voltage levels (high and low levels) of the switch control signal Sc.

When the first and second switching circuits 40, 42 are supplied with the switch control signal Sc (e.g., the high voltage level) to select the first pulse generation sources 22*a*, 44*a*, respectively, the first voltage Va1 is applied between the cathode electrode 16 and GND in the preparatory period T1, polarizing the emitter 14, and the second voltage Va2 is applied between the cathode electrode 16 and GND in the electron emission period T2, reversing or changing the polarization of the emitter 14 for causing the cathode electrode 16 to discharge primary electrons, which excite the fluorescent body 28 to emit light.

If the above process is regarded as one step, then the step is performed one time or a plurality of times as long as the switch control signal Sc is of the high voltage level, thereby carrying out one cycle (first cycle) of operation.

When the first and second switching circuits 40, 42 are supplied with the switch control signal Sc (e.g., the low voltage level) to select the second pulse generation sources 22*b*, 44*b*, respectively, the first voltage Va1 is applied between the anode electrode 20 and GND in the preparatory period T1, polarizing the emitter 14, and the second voltage Va2 is applied between the anode electrode 20 and GND in the electron emission period T2, reversing the polarization of the emitter 14 for causing the anode electrode 20 to discharge primary electrons, which excite the fluorescent body 28 to emit light.

If the above process is regarded as one step, then the step is performed one time or a plurality of times as long as the switch control signal Sc is of the low voltage level, thereby carrying out one cycle (second cycle) of operation.

Based on a command signal from the computer or the timer, the first and second switching circuits 40, 42 switch between the first cycle and the second cycle per step or per number of steps.

According to the second driving process, primary electrons can be discharged from the cathode electrode in the first cycle and primary can be discharged from the anode electrode in the second cycle for further increasing the electron emission efficiency.

As shown in FIG. 11, the outer peripheral edge of the cathode electrode 16 is surrounded by the fluorescent body 28, and the outer peripheral edge of the fluorescent body 28 is surrounded by the anode electrode 20, or the outer peripheral edge of the anode electrode 20 is surrounded by the fluorescent body 28, and the outer peripheral edge of the fluorescent body 28 is surrounded by the cathode electrode 16. Consequently, the outer peripheral portion of the cathode electrode 16 and the outer peripheral portion of the anode electrode 20 contribute to the emission of electrons, thus increasing the amount of emitted light. By appropriately selecting the area of the cathode electrode 16 and the projected shape thereof as viewed in plan, the amount of emitted light and the electrostatic capacitance between the cathode electrode 16 and the anode electrode 20 can be optimized for reducing the power consumption and increasing the amount of emitted light.

A light emission device 10C according to a third embodiment of the present invention will be described below with reference to FIGS. 16 through 18.

Figure 16:
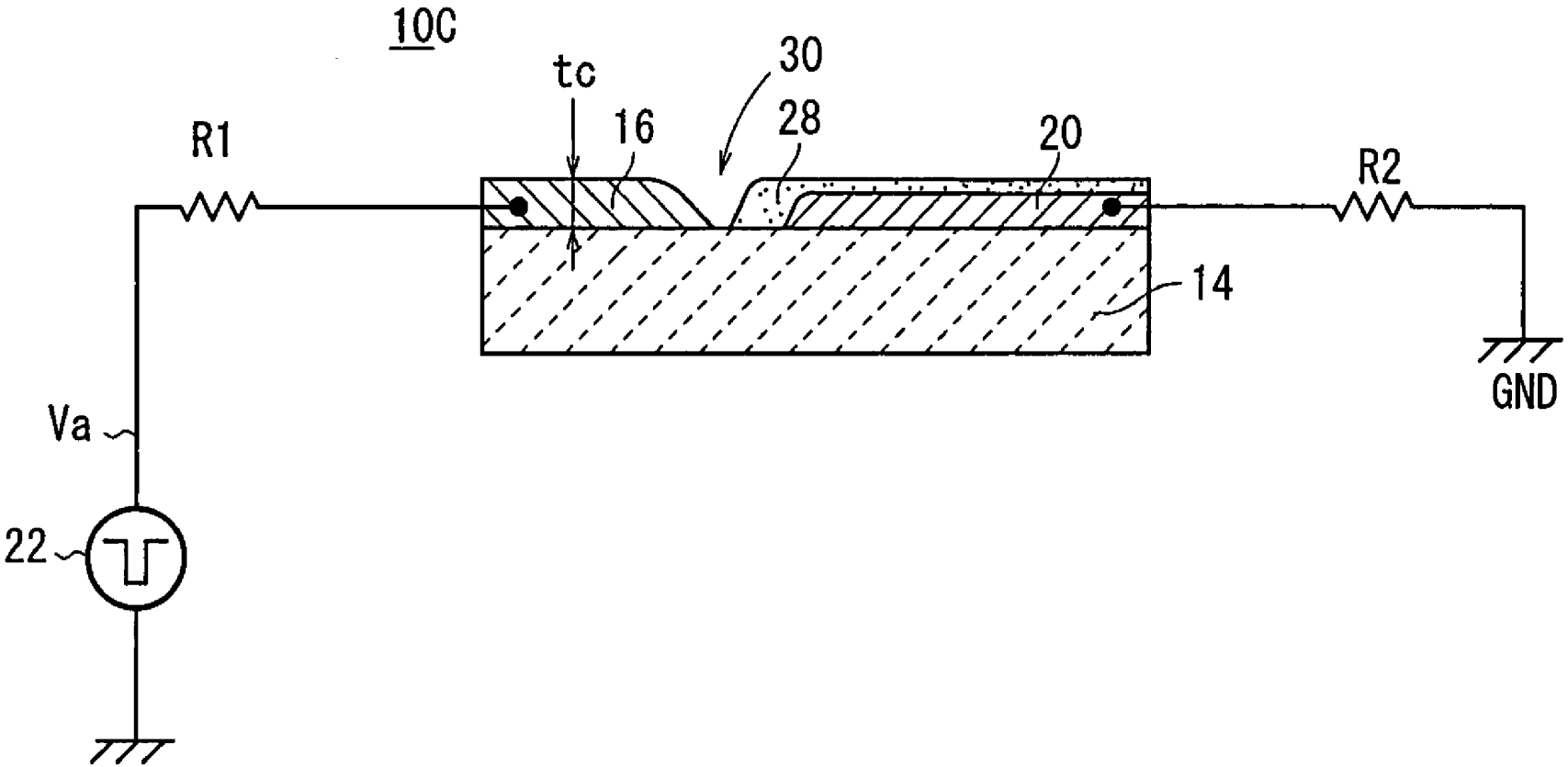
FIG. 16 is a view of a light emission device according to a third embodiment of the present invention.
Figure 17:
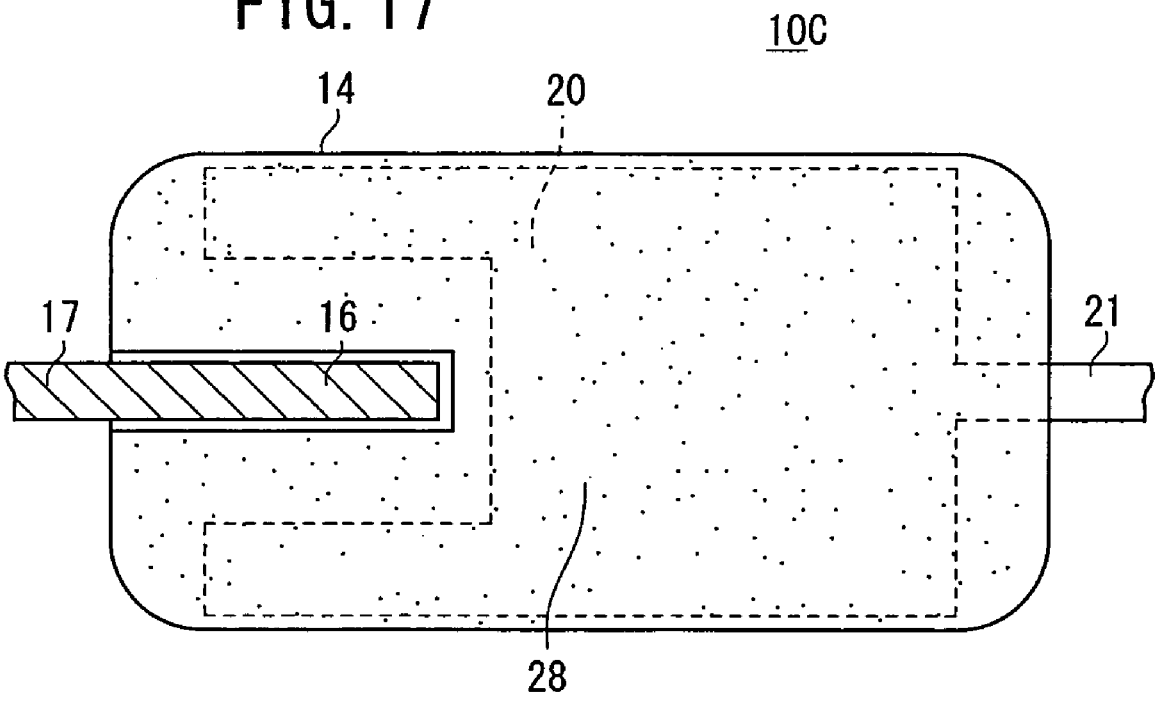
FIG. 17 is a plan view of the light emission device according to the third embodiment of the present invention.

As shown in FIGS. 16 and 17, the light emission device 10C according to the third embodiment is substantially similar in structure to the light emission device 10B according to the second embodiment, but differs therefrom in that the fluorescent body 28 covers the surface of the anode electrode 20.

The fluorescent body 28 thus performs the function of a charged film and the function of a protective film.

A process of driving the light emission device 10C will be described below with reference to FIGS. 6, 16 through 18. According to the third embodiment, as with the first embodiment, as shown in FIG. 6, a step including a period in which the first voltage Va1 is outputted (preparatory period T1) and a period in which the second voltage Va2 is outputted (electron emission period T2) is repeated.

In the preparatory period T1, although not shown, the first voltage Va1 is applied between the cathode electrode 16 and the anode electrode 20 to polarize the emitter 14 in one direction.

Figure 18:
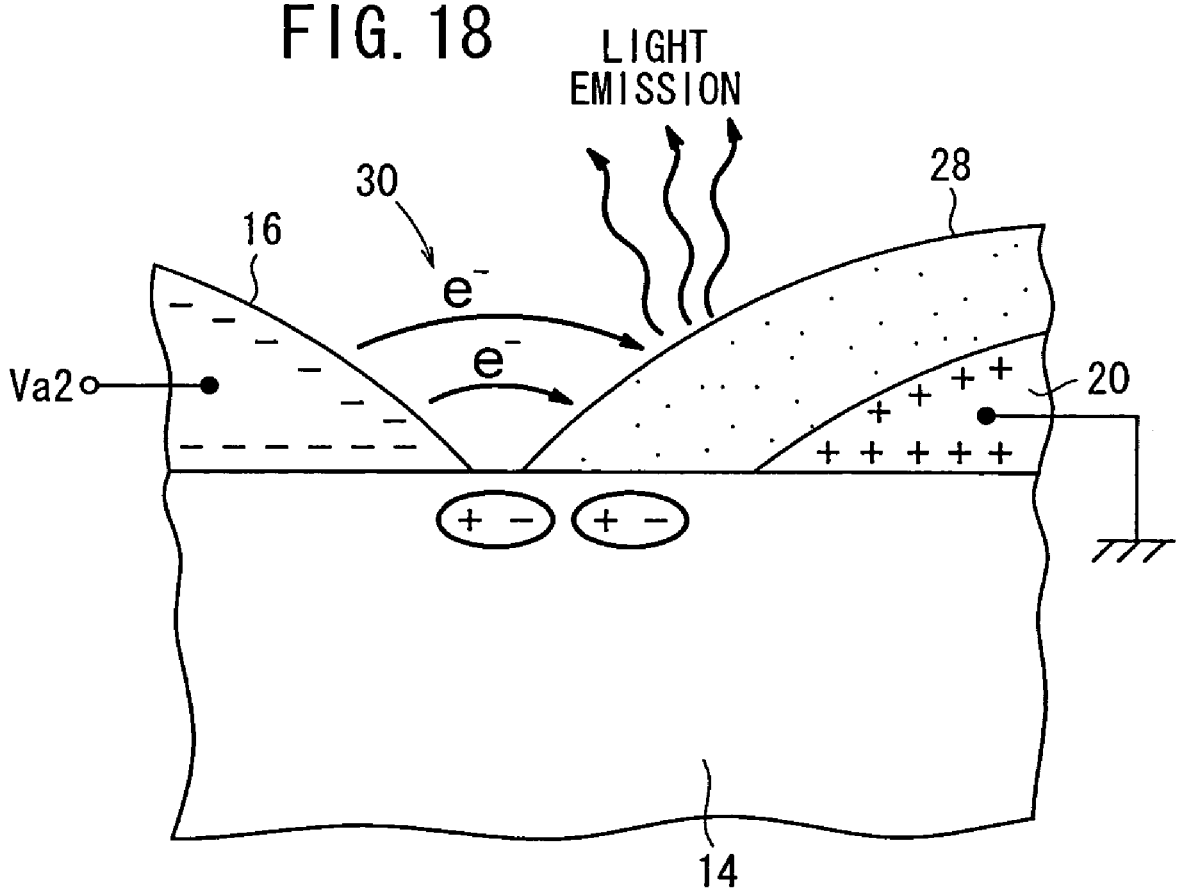
FIG. 18 is a view showing the manner in which light is emitted from the light emission device according to the third embodiment of the present invention.

Subsequently, in the electron emission period T2, the second voltage Va2 is applied between the cathode electrode 16 and the anode electrode 20 to reverse the polarization of at least a portion (corresponding to the slit 30) of the emitter 14, as shown in FIG. 18. Because of the reversed polarization, a locally concentrated electric field is produced in the cathode electrode 16 and the positive poles of dipole moments in the vicinity of the cathode electrode 16, causing the cathode electrode 16 to emit primary electrons.

At this time, when some of the discharged electrons are drawn to the anode electrode 20, they negatively charge the surface of the fluorescent body 28. The positive polarity of the anode electrode 20 is now weakened, reducing the intensity of the electric field between the cathode electrode 16 and the anode electrode 20, thereby instantaneously stopping the ionization. Thus, there is essentially no change in the voltage between the cathode electrode 16 and the anode electrode 20 upon the emission of electrons. As a result, almost no positive ions are produced, thus preventing the cathode electrode 16 from being damaged by positive ions. The light emission device 10C can thus have an increased service life.

Although certain preferred embodiments of the present invention have been shown and described in detail, it should be understood that various changes and modifications may be made therein without departing from the scope of the present invention.

What is claimed is:

1. A light emission device comprising:

a substance disposed in a vacuum atmosphere and sewing as an emitter made of a dielectric material; and a first electrode, a second electrode, and a fluorescent body which are disposed in contact with said substance serving as the emitter;

wherein when a drive voltage is applied between said first electrode and said second electrode, the polarization of at least a portion of said substance serving as the emitter is reversed or changed to emit electrons from at least a portion of said first electrode, and said electrons impinge upon said fluorescent body to emit light therefrom.

2. A light emission device according to claim 1, wherein said first electrode and said fluorescent body are disposed on a first surface of said substance serving as the emitter, and said second electrode is disposed on a second surface of said substance serving as the emitter.

3. A light emission device according to claim 2, wherein said first electrode and said fluorescent body have an outer peripheral edge and an inner peripheral edge, respectively which face each other.

4. A light emission device according to claim 2, wherein said fluorescent body and said first electrode have an outer peripheral edge and an inner peripheral edge, respectively, which face each other.

5. A light emission device according to claim 2, wherein said first electrode and said second electrode have respective projected shapes as viewed in plan, and the projected shape of said second electrode has a protruding portion which protrudes from a peripheral edge of the projected shape of said first electrode.

6. A light emission device according to claim 5, wherein the projected shape of said first electrode and the projected shape of said second electrode are similar to each other.

7. A light emission device according to claim 5, wherein said protruding portion has a maximum length ranging from 1 μm to 500 μm.

8. A light emission device according to claim 1, wherein said first electrode and said second electrode are disposed in contact with a principal surface of said substance serving as the emitter, with a slit defined between said first electrode and said second electrode, said fluorescent body being disposed in at least said slit.

9. A light emission device according to claim 8, wherein said substance serving as the emitter has a portion exposed at least between said first electrode and said fluorescent body.

10. A light emission device according to claim 8, wherein said first electrode and said fluorescent body have an outer peripheral edge and an inner peripheral edge, respectively, which face each other.

11. A light emission device according to claim 10, wherein said fluorescent body and said second electrode have an outer peripheral edge and an inner peripheral edge, respectively, which face each other.

12. A light emission device according to claim 8, wherein said second electrode and said fluorescent body have an outer peripheral edge and an inner peripheral edge, respectively, which face each other.

13. A light emission device according to claim 12, wherein said fluorescent body and said first electrode have an outer peripheral edge and an inner peripheral edge, respectively, which face each other.

14. A light emission device according to claim 8, wherein said fluorescent body is disposed in covering relation to said second electrode.

15. A light emission device according to claim 8, wherein a step includes a preparatory period in which a first voltage making the potential of said first electrode higher than the potential of said second electrode is applied between said first electrode and said second electrode to polarize said substance serving as the emitter, and an electron emission period in which a second voltage making the potential of said first electrode lower than the potential of said second electrode is applied between said first electrode and said second electrode to reverse the polarization of said substance serving as the emitter to emit electrons from said first electrode, and a first cycle includes at least one said step, wherein a step includes a preparatory period in which said second voltage is applied between said first electrode and said second electrode to polarize said substance serving as the emitter, and an electron emission period in which said first voltage applied between said first electrode and said second electrode to reverse the polarization of said substance serving as the emitter to emit electrons from said second electrode, and a second cycle includes at least one said step, and wherein operation of said first cycle and operation of said second cycle are selectively performed.

16. A light emission device according to claim 15, wherein electrons are emitted from a portion of said first electrode in the vicinity of a triple point made up of said first electrode, said substance serving as the emitter, and a vacuum atmosphere during said electron emission period in said step of said first cycle, and the emitted electrons impinge upon said fluorescent body to emit light therefrom, and wherein electrons are emitted from a portion of said second electrode in the vicinity of a triple point made up of said second electrode, said substance serving as the emitter, and a vacuum atmosphere during said electron emission period in said step of said second cycle, and the emitted electrons impinge upon said fluorescent body to emit light therefrom.

17. A light emission device according to claim 15, wherein electrons are emitted from a portion of said first electrode in the vicinity of a triple point made up of said first electrode, said substance serving as the emitter, and a vacuum atmosphere during said electron emission period in said step of said first cycle, and the emitted electrons are reflected by a surface of said substance serving as the emitter and impinge upon said fluorescent body to emit light therefrom, and wherein electrons are emitted from a portion of said second electrode in the vicinity of a triple point made up of said second electrode, said substance serving as the emitter, and a vacuum atmosphere during said electron emission period in said step of said second cycle, and the emitted electrons are reflected by a surface of said substance serving as the emitter and impinge upon said fluorescent body to emit light therefrom.

18. A light emission device according to claim 15, wherein electrons are emitted from a portion of said first electrode in the vicinity of a triple point made up of said first electrode, said substance serving as the emitter, and a vacuum atmosphere during said electron emission period in said step of said first cycle, the emitted electrons impinge upon a surface of said substance serving as the emitter to emit secondary electrons therefrom, and said secondary electrons impinge upon said fluorescent body to emit light therefrom, and wherein electrons are emitted from a portion of said second electrode in the vicinity of a triple point made up of said second electrode, said substance serving as the emitter, and a vacuum atmosphere during said electron emission period in said step of said second cycle, the emitted electrons impinge upon said substance serving as the emitter to emit secondary electrons therefrom, and said secondary electrons impinge upon said fluorescent body to emit light therefrom.

19. A light emission device according to claim 1, wherein a step includes a preparatory period in which a first voltage making the potential of said first electrode higher tan the potential of said second electrode is applied between said first electrode and said second electrode to polarize said substance serving as the emitter, and an electron emission period in which a second voltage making the potential of said first electrode lower than the potential of said second electrode is applied between said first electrode and said second electrode to reverse or change the polarization of said substance serving as the emitter to emit electrons therefrom, and said step is repeated.

20. A light emission device according to claim 19, wherein electrons are emitted from a portion of said first electrode in the vicinity of a triple point made up of said first electrode, said substance serving as the emitter, and a vacuum atmosphere during said electron emission period in said step, and the emitted electrons impinge upon said fluorescent body to emit light therefrom.

21. A light emission device according to claim 19, wherein electrons are emitted from a portion of said first electrode in the vicinity of a triple point made up of said first electrode, said substance serving as the emitter, and a vacuum atmosphere during said electron emission period in said step, and the emitted electrons are reflected by a surface of said substance serving as the emitter and impinge upon said fluorescent body to emit light therefrom.

22. A light emission device according to claim 19, wherein electrons are emitted from a portion of said first electrode in the vicinity of a triple point made up of said first electrode, said substance serving as the emitter, and a vacuum atmosphere during said electron emission period in said step, the emitted electrons impinge upon said substance serving as the emitter to emit secondary electrons therefrom, and said secondary electrons impinge upon said fluorescent body to emit light therefrom.

23. A light emission device according to claim 1, wherein said vacuum atmosphere has a vacuum level of at most 2000 Pa.

24. A light emission device according to claim 23, wherein said vacuum atmosphere has a vacuum level of at most $10^{-3}$ Pa.

25. A light emission device according to claim 1, wherein said substance serving as the emitter is made of a piezoelectric material, an anti-ferroelectric material, or an electrostrictive material.

26. A light emission device comprising:

a substance disposed in a vacuum atmosphere and serving as an emitter made of a dielectric material; and a first electrode, a second electrode, and a fluorescent body which are disposed in contact with said substance serving as the emitter, said fluorescent body being spaced from said first electrode and said second electrode;

wherein when a drive voltage is applied between said first electrode and said second electrode, the polarization of at least a portion of said substance serving as the emitter is reversed or changed to emit electrons from at least a portion of said first electrode, and said electrons impinge upon said fluorescent body to emit light therefrom.

27. A light emission device comprising:

a substance disposed in a vacuum atmosphere and serving as an emitter made of a dielectric material; and a first electrode, a second electrode, and a fluorescent body which are disposed in contact with said substance serving as the emitter;

wherein when a drive voltage is applied between said first electrode and said second electrode, the polarization of at least a portion of said substance serving as the emitter is reversed or changed to emit electrons from at least a portion of said first electrode, and said electrons pass through said vacuum before impinging upon said fluorescent body to emit light therefrom.

* * * * *

UNITED STATES PATENT AND TRADEMARK OFFICE

CERTIFICATE OF CORRECTION

PATENT NO. : 7,067,970 B2
APPLICATION NO. : 10/647794
DATED : June 27, 2006
INVENTOR(S) : Yukihisa Takeuchi, Tsutomu Nanataki and Iwao Ohwada It is certified that error appears in the above-identified patent and that said Letters Patent is hereby corrected as shown below:

Column 19

*Line 28*: please change “sewing” to --serving--

Column 21

*Line 32*: please change “tan” to --than--

Signed and Sealed this

Twenty-eighth Day of November, 2006

JON W. DUDAS
*Director of the United States Patent and Trademark Office*